US008555949B2

(12) United States Patent
Mortier

(10) Patent No.: US 8,555,949 B2
(45) Date of Patent: Oct. 15, 2013

(54) OVERHEAD DOOR WITH SPRING-LOADED ROLLER HINGES

(76) Inventor: Lester L. Mortier, Lena, WI (US)

( * ) Notice: Subject to any disclaimer, the term of this patent is extended or adjusted under 35 U.S.C. 154(b) by 92 days.

(21) Appl. No.: 13/135,941

(22) Filed: Jul. 18, 2011

(65) Prior Publication Data

US 2012/0145337 A1 Jun. 14, 2012

Related U.S. Application Data

(60) Provisional application No. 61/399,762, filed on Jul. 16, 2010, provisional application No. 61/459,071, filed on Dec. 6, 2010, provisional application No. 61/519,963, filed on Jun. 2, 2011.

(51) Int. Cl.
*E05D 15/00* (2006.01)
*E05D 15/06* (2006.01)

(52) U.S. Cl.
USPC ..... 160/201; 16/97

(58) Field of Classification Search
USPC ..... 160/201, 202, 229.1, 199, 206; 16/97, 16/104, 357, 360, 361, 387, 389, 392, 102, 16/103, 106
See application file for complete search history.

(56) References Cited

U.S. PATENT DOCUMENTS 1,985,976 A * 1/1935 Clark ..... 160/209
2,006,228 A 6/1935 Collins
2,059,585 A 11/1936 Kelly
2,069,655 A 2/1937 Bouthillier
2,189,019 A 2/1940 Rowe
2,352,639 A 7/1944 Kinish
2,426,567 A 8/1947 Snider
2,525,309 A * 10/1950 Norberg ..... 16/97
2,701,896 A 2/1955 Fritz
2,703,141 A 3/1955 McKee
3,034,575 A 5/1962 Stroup
4,000,540 A 1/1977 Newlon
4,119,133 A 10/1978 Wolf
4,120,072 A * 10/1978 Hormann ..... 16/87 R
4,692,963 A 9/1987 Barroero
4,800,618 A 1/1989 Putz
4,815,164 A 3/1989 Rottinghaus
5,235,724 A 8/1993 Perrin et al.
5,826,306 A 10/1998 Faubert et al.
5,884,363 A * 3/1999 Tofts ..... 16/223
5,921,307 A 7/1999 Ford et al.
6,729,380 B2 5/2004 Whitley et al.
6,928,696 B2 8/2005 Wartman
7,036,548 B2 5/2006 Johnston et al.
7,350,333 B2 4/2008 Michaud et al.

(Continued)

*Primary Examiner* — Katherine Mitchell
*Assistant Examiner* — Jeremy Ramsey
(74) *Attorney, Agent, or Firm* — Jeffrey S. Sokol

(57) ABSTRACT

An overhead door with spring-loaded roller hinges that push the door against its frame or weather stripping to provide an effective weather and thermal seal when the door is closed. The spring-loaded roller hinges are readily retrofit to overhead doors with conventional roller hinges. Each hinge spaces and pivotally secures a roller hub from the base of the hinge. The roller hub is pivotally secured to an inside flange and movably held by an elongated slot in an outer flange. The roller hub supportingly receives the axle of a wheel that rollingly engages a track fixed to the vertical sides of the door frame. Each roller hinge has a spring that biases its roller hub and wheel rearwardly against the fixed track, which pushes the door panels forward and into sealing engagement with the door frame or its weather stripping.

20 Claims, 22 Drawing Sheets

(56) References Cited

U.S. PATENT DOCUMENTS

| | | | | |
|---|---|---|---|---|
| 7,546,663 | B2 | 6/2009 | Duffy | |
| 7,600,551 | B2 | 10/2009 | Lussier | |
| 7,685,950 | B2 | 3/2010 | Friesen | |
| 7,726,378 | B1 * | 6/2010 | Savon | 160/201 |
| 7,784,520 | B2 * | 8/2010 | Paulson | 160/201 |
| 7,857,031 | B2 | 12/2010 | Mihalcheon et al. | |

* cited by examiner 12
38
40
8
11
31
12
37
51
40
91
71
84
61
81
12
36
40
12

OVERHEAD DOOR WITH SPRING-LOADED ROLLER HINGES

This application claims priority on U.S. Provisional Application No. 61/399,762 filed Jul. 16, 2010; U.S. Provisional Application No. 61/459,071 filed Dec. 6, 2010 and U.S. Provisional Application No. 61/519,963 filed Jun. 2, 2011.

TECHNICAL FIELD OF THE INVENTION

This invention relates to an overhead door with spring-loaded roller hinges to provide a more effective weather and thermal seal when the door is closed.

BACKGROUND OF THE INVENTION

Conventional overhead doors include several horizontal panels joined in series to allow the door to move along a track between a lower vertical closed position and a raised horizontal open position. Adjacent panels are pivotally joined by roller hinges that allow the door to move along both the straight and curved sections of the track as shown in FIGS. 1A-1F. Each roller hinge holds a roller wheel that rollingly engages the track. The door is slightly wider than the door frame so that sides of the door extend beyond or overlap the vertical side portions of the door frame. The bottom end of the door engages the horizontal floor of the building and preferably includes weather stripping to better seal the door against the floor of the building. The door is also slightly taller than the door frame so that the top end of the door extends beyond or overlaps the upper horizontal portion of the door frame. A piece of weather stripping can be secured to the top of the door to help seal it against the door frame.

Some conventional overhead doors provide an adjustable track to adjustable space the vertical section of the track to the vertical sides of the door frame. This adjustability helps align the track so that the sides of the door will better seal against the vertical sides of the door frame. One way to achieve this track adjustability is to provide a slot in the brackets that secure the track to the door frame as shown in FIG. 1F. When the vertical section of the track is aligned to properly space the door to the door frame, bolts passing through these slots are tightened down to fix the track to the door frame. A problem with conventional overhead doors is that they do allow for this track adjustability toward the top of the vertical section of the track. In addition, many overhead doors do not provide track brackets with slots or other mechanisms to adjustably align and space the track with the door.

Another problem with conventional overhead doors is that the door panels do not seal against the vertical side sections of the door frame or weather stripping when the door is closed as shown in FIG. 1B. A continuous gap or series of intermittent gaps exists between the door panels and the vertical sides of the fixed door frame. These gaps can be an unintended result of poor track and door installation, settling of the building or warping of the door frame, or the gaps can be an intended design feature. Unfortunately, when these doors are used in colder or hotter regions, the gaps allow outside air to blow or flow into the interior of the building, which dramatically increases heating costs on cold days, and cooling costs on hot days. The gaps can also cause unsafe conditions on cold days when ice forms inside near the door even when the door remains closed. Although weather stripping can help alleviate some gap and air leak problems, these problems frequently persist because the weather stripping can be torn or damaged, is insufficient to close the gap, or looses its resilience over time and on colder days when a good seal is most needed.

A further problem with conventional overhead doors in providing a proper seal between the door and door frame is the varying height of the roller hinges. To prevent binding and allow the door to release or move away from the door frame when the door is out of its closed position, the track is angled slightly toward the inside of the building and away from the generally vertical door frame as the track progresses up the sides of the door frame. To accommodate this inward angling of the track, the height of the roller hinge flanges increase the closer the hinge is to the top of the vertical section of the track, and decrease in height the closer the hinge is to the bottom of the track or floor of the building. The varying flange heights of both the dual-hub and low profile roller hinges complicates the physical structure of conventional mechanisms used to help ensure that the door properly engages the door frame or its weather stripping when closed.

A further problem with conventional overhead door assemblies is that the two lower door panels are joined by a low profile roller hinge that is structurally different than the other roller hinges that join the upper door panels. The upper roller hinges have a pivoting hub to allow pivoting movement of the adjacent door panels. The upper roller hinge also has a separate roller hub for securing the roller wheels that engage the track of the door assembly. The lower low-profile roller hinges have a single combined pivoting roller hub that allows pivoting movement of the two lower door panels and secures the roller wheel that engages the track of the door assembly. Accordingly, the mechanism for sealing the door panels should be adaptable to work in both single and dual hub roller hinges.

The present invention is intended to solve these and other problems.

BRIEF DESCRIPTION OF THE INVENTION

This invention pertains to an overhead door with spring-loaded roller hinges to push the door against its frame or weather stripping to provide an effective weather and thermal seal when closed. The spring-loaded roller hinges are readily retrofit to overhead doors with conventional roller hinges that pivotally join adjacent door panels. Each spring-loaded roller hinge is rigidly secured to the inside surfaces of two adjacent door panels. The hinge has a bracket with opposed inner and outer flanges that space a roller hub from and pivotally secure it to the bracket and door panels. The roller hub is pivotally secured to the inside flange of the bracket and movably held by an elongated slot in its outer flange. The roller hub supportingly receives a roller with an axle and a wheel that rollingly engages a track fixed to the vertical side portions of the stationary door frame. Each roller hinge has a spring that biases its roller hub and wheel rearwardly against the fixed track, which pushes the door panels forward and into sealing engagement with the door frame or its weather stripping as shown in FIGS. 2B, 2C and 3A.

An advantage of the present overhead door with spring-loaded roller hinges is that it allows the door to properly engage the vertical portions of the frame or weather stripping to achieve an effective weather and thermal seal when the door is closed.

A further advantage of the present spring-loaded roller hinges is that they are readily retrofit to a wide variety of conventional overhead doors. For example, the spring-loaded roller hinges can be readily used in door assemblies with either adjustable or non-adjustable tracks.

Another advantage of the present overhead door with spring-loaded roller hinges is its adaptability to the varying flange heights of the roller hinges. The slot in the middle dual-hub spring-loaded roller hinges is moved further up the flange then for the lower or shorter dual-hub spring-loaded roller hinge. Similarly, the slot in the upper or taller dual-hub spring-loaded roller hinge is moved still further up the flange then for the middle dual-hub spring-loaded roller hinge. In addition, the springs are easily modified to accommodate the varying slot locations. When torsion springs wrapped around the hinge hub are used, the length of one spring leg is modified to accommodate the varying slot locations. When helical springs are used, the length of the helical spring is slightly longer for the middle hinge than the shorter hinge, and still longer for the taller hinge. The present design avoids the need for more complex and expensive structures to accommodate the varying height of the roller hinges.

A further advantage of the present overhead door with spring-loaded roller hinges is that it avoids or minimizes binding between the door and its frame. There is a one inch overlap on each side of the door 10 relative to the door jam or frame 7. The panels 11 press directly and flushly against the door jam 11 when the door 10 is closed or is being raised to its open position. No weather stripping is located directly between the door panel 11 and door jam 7. Weather stripping can secured to the perpendicular sides of the door frame to press into or against the door panels 11. The springs allow the door to release from and avoid any binding with the door frame.

A still further advantage of the present overhead door with spring-loaded roller hinges is that it prevents light, noise, heat, cold, wind, rain, snow, dust, bugs and spiders from getting into the inside of the building.

Other aspects and advantages of the invention will become apparent upon making reference to the specification and drawings.

DESCRIPTION OF THE PREFERRED EMBODIMENT

While this invention is susceptible of embodiment in many different forms, the drawings show and the specification describes in detail a preferred embodiment of the invention. It should be understood that the drawings and specification are to be considered an exemplification of the principles of the invention. They are not intended to limit the broad aspects of the invention to the embodiment illustrated.

Figure 1A:
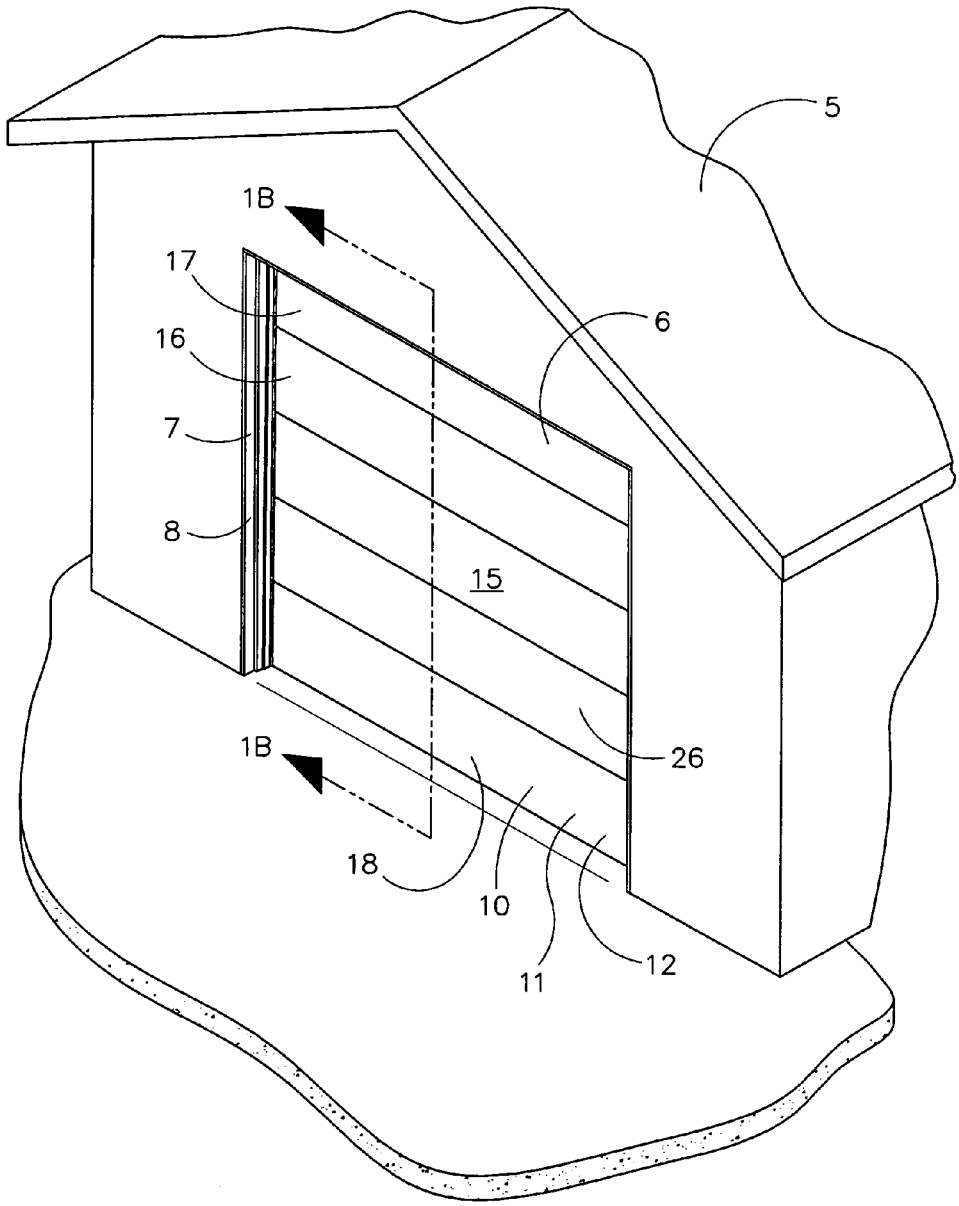
FIG. 1A PRIOR ART
FIG. 1A is a perspective view showing a portion of the outside of a building with a large door opening and a conventional five-panel overhead door closing the opening.
Figure 1B:
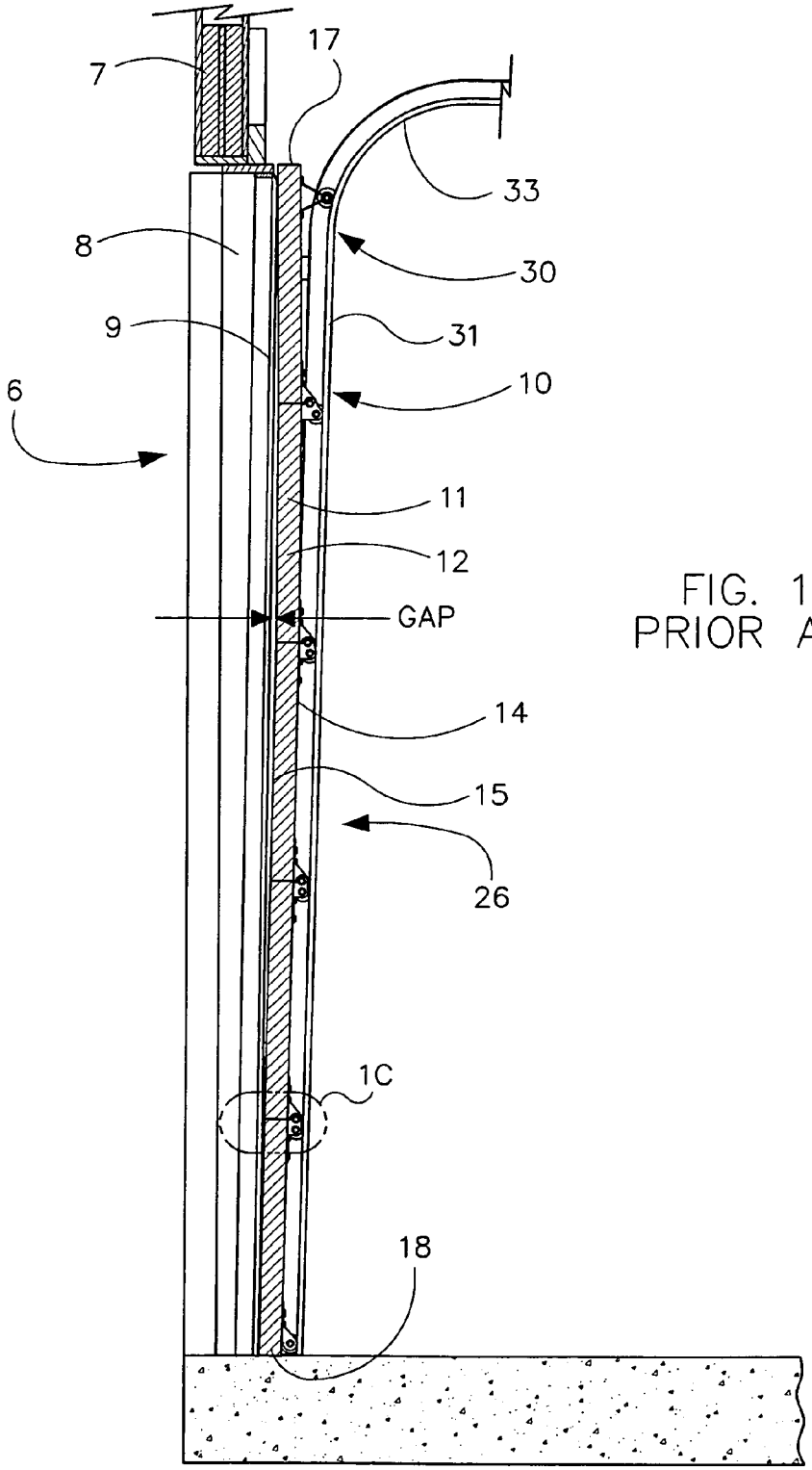
FIG. 1B PRIOR ART
FIG. 1B is a side sectional view taken along lines 1B-1B of FIG. 1A showing the arrangement of a conventional overhead door relative to the framing around the door opening when the door is in its closed position, the five door panels being joined by a top roller bracket, a bottom roller bracket and four conventional roller hinges to allow the door to move along straight and curved sections of the track the track, the vertical section of track being slightly angled away from the framing along the side of the opening, the five-panel door and its two conventional roller brackets and four conventional roller hinges securing the door to the track, with the door being in its closed position, and with a gap between the door panels and the vertical framing and its corresponding weather stripping along the side of the door.
Figure 1C:
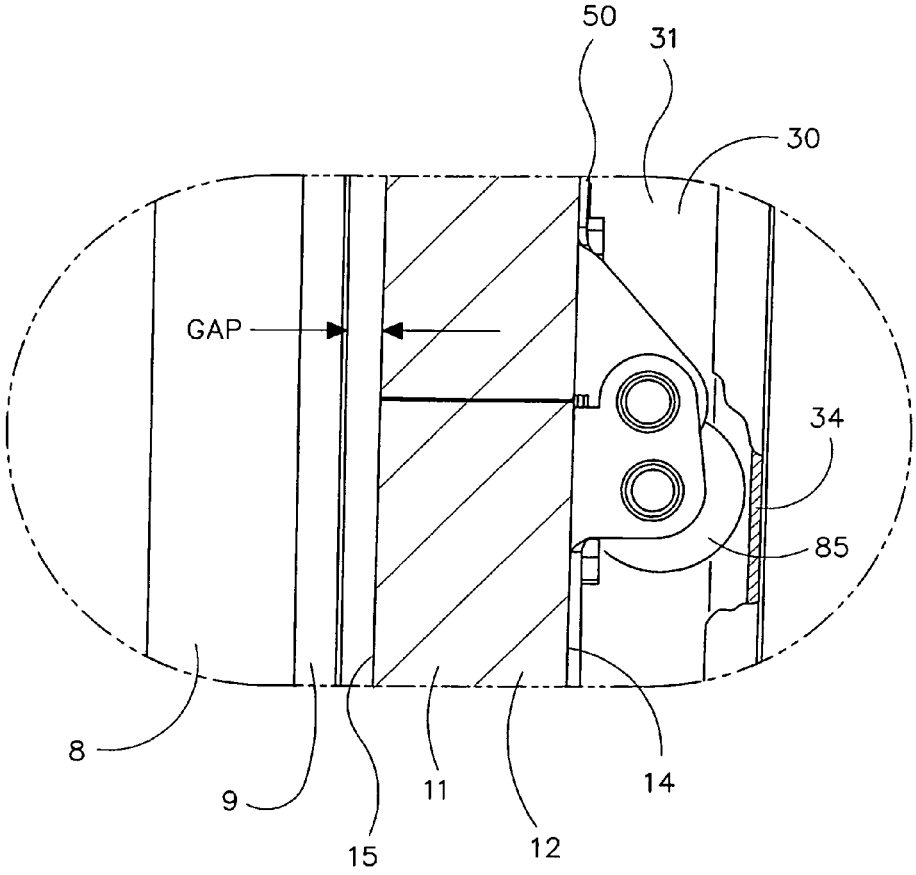
FIG. 1C PRIOR ART
FIG. 1C is an enlarged view of a middle conventional roller hinge of FIG. 1B showing its fixed wheel and axle, with the wheel secured in its track with a slight gap between the wheel and inner or rearward end of the track, and with a gap between the front of two adjacent door panels and the framing along the side of the opening.
Figure 1D:
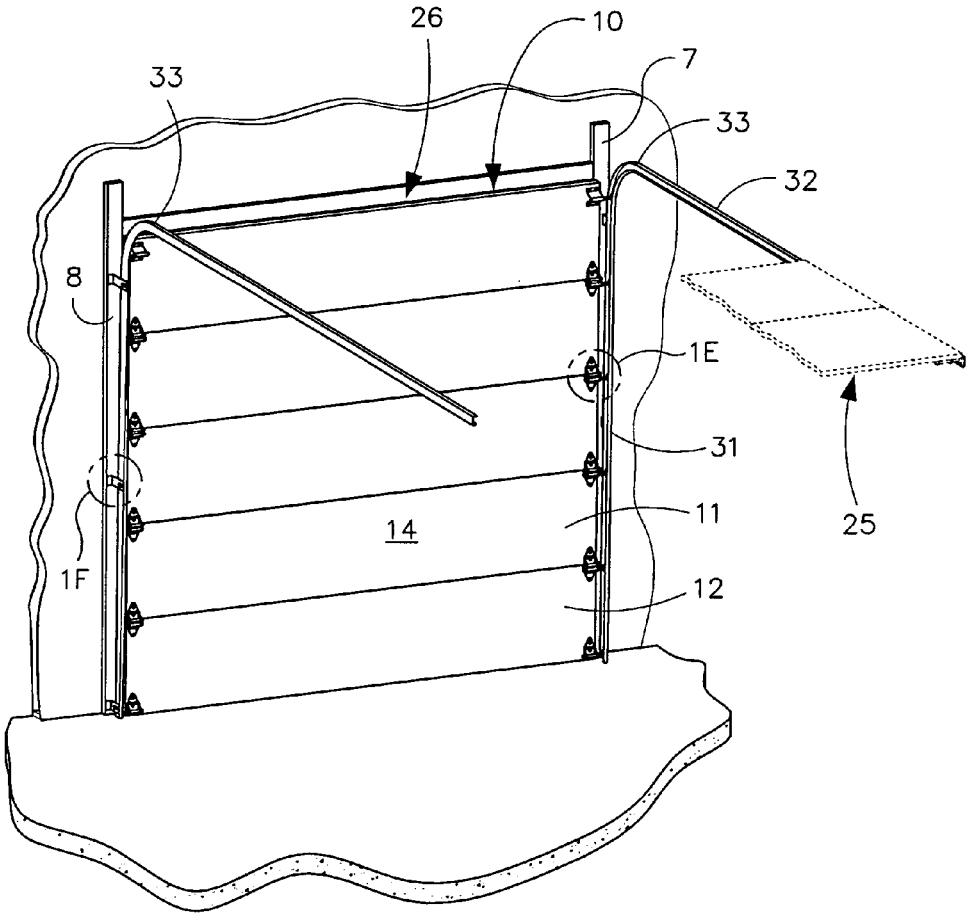
FIG. 1D PRIOR ART
FIG. 1D is a perspective view showing the conventional overhead door with five panels pivotally joined by two top roller brackets, two bottom roller brackets and four sets of conventional roller hinges, and showing the door in its raised overhead or open position in phantom.
Figure 1E:
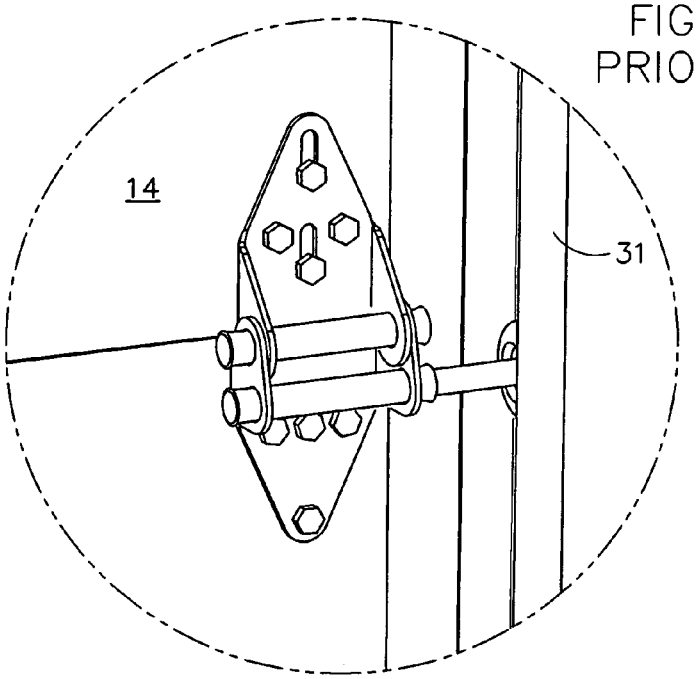
FIG. 1E PRIOR ART
FIG. 1E is an enlarged view of one conventional roller hinge in FIG. 1D showing its mating brackets, side flanges, fixed hinge hub and fixed wheel hub receiving a wheel assembly engaging its track.
Figure 1F:
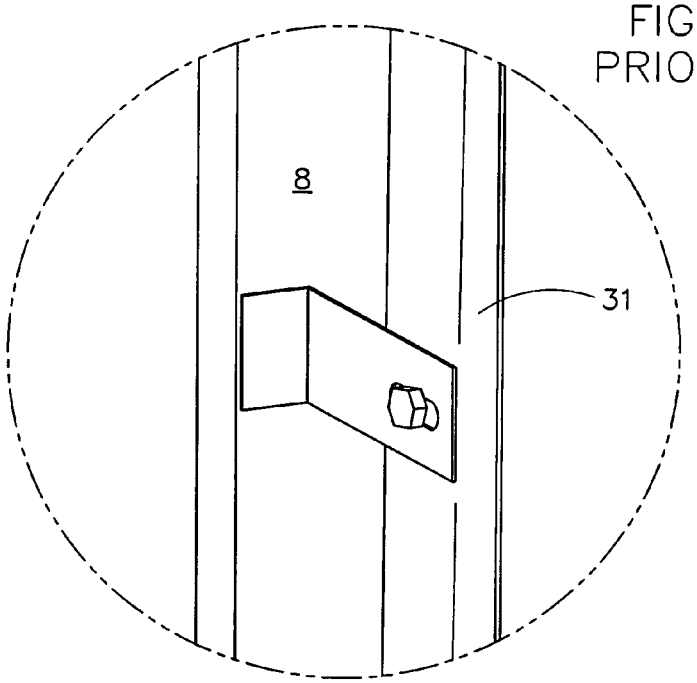
FIG. 1F PRIOR ART
FIG. 1F is an enlarged view of the conventional lower track bracket in FIG. 1D showing its slot to adjustably align track with the vertical section of the door frame with a tightened down bolt passing through the slot to fix the track to the door frame.

FIG. 1A shows a building 5 with an opening 6 to access an enclosed interior area. The opening 6 is formed by a frame 7 that includes opposed side framing 8 and top framing. The bottom of the opening 6 is formed by a floor or ground surface. The present invention relates to an overhead door assembly with spring-loaded roller hinges that is generally indicated by reference number 10. The overhead door assembly 10 includes a door 11 formed by several uniformly shaped rectangular panels 12 that extend horizontally from one side 8 of the door frame 7 to the other. When the door 11 is closed, its inside surface 14 faces the interior of the building 5, and its outside surface 15 faces the exterior of the building. The door 11 has opposed sides 16, a top 17 and a bottom 18. Each panel 12 extends from one side 16 of the door to the other. The door 11 is typically slightly wider than the door opening 6 so that its side edges 16 overlap the door frame 7 when closed. In some more economical residential garage door assemblies 10, the door 11 is about the same width as the opening 6 with weather stripping along the inside of the framing 8 to engage the sides 16 of the door 11. The door 11 is selectively movable between a raised or opened position 25 and a lowered or closed positions 26.

The overhead door assembly 10 includes a pair of tracks 30 that support and guide the movement of the door 11 between its open and closed positions 25 and 26. Each track 30 has a lower vertical portion 31 that is joined to an elevated horizontal portion 32 by a curved portion 33. The vertical 31 and horizontal 32 portions of the track 30 are substantially linear. The vertical portions 31 of the tracks 30 are rigidly secured to each side of the door frame 7. Each track 30 has an inwardly facing C-shaped cross section to securely engage and retain the roller wheels located along the sides 16 of the door 11. The generally vertical track portions 31 guide the door 11 into its closed position 26. The generally horizontal track portions 32 guide the door 11 into its open position 26. The vertical track portions 31 are preferably angled slightly outward away from the side framing 8 and inwardly toward the interior of the building 5 as the track extends upward. The angle of the vertical track portions 31 relative to the side framing 8 is generally about a ½° to 1° angle, but can vary from one door installation to another. The inward angling of the track helps release the door 11 from engagement with the door frame 7 as the door moves up from its closed position 26.

Figure 2A:
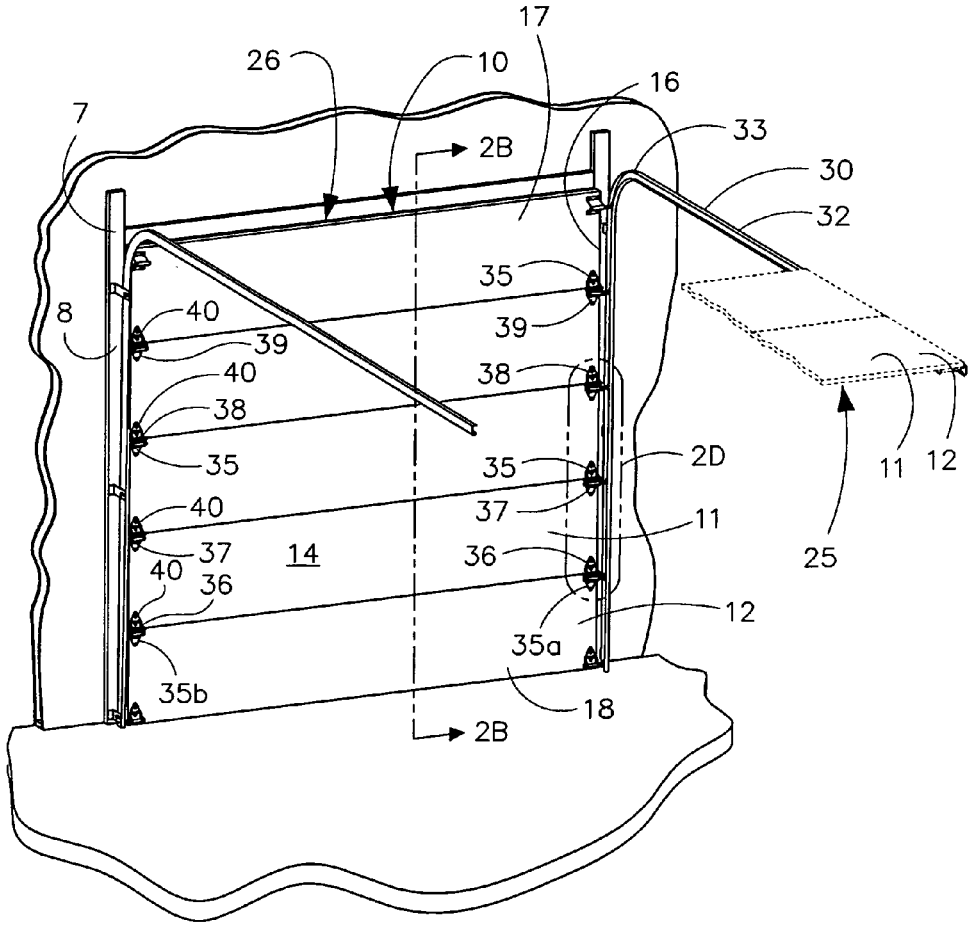
FIG. 2A is an perspective view of the present overhead door assembly invention on a five-panel door with two conventional top hinges, two conventional bottom hinges and four matched sets of spring-loaded roller hinges with their wheels engaging opposed tracks fixed along the sides of the door frame when the door in its closed position, and with the door shown in phantom in its raised overhead or open position.

Each overhead door assembly 11 is fitted with a complete set 35 of spring-loaded roller hinges. For a five panel door as shown in FIG. 2A, a complete set 35 includes a four matched sets 36-39 of roller hinges. Each matched set 36-39 includes two roller hinges. One right handed hinge 35*a* of each matched set 36-39 is secured along the right side of the door 11, and one left handed hinge 35*b* of each matched set is secured along the left side of the door. Each right handed hinge in a particular set 36-39 is a mirror image of its corresponding left handed hinge in that set. Each set 35 includes a plurality of dual-hub, spring-loaded roller hinges 40. (FIGS. 4-7). The hinges 40 forming each set 36-39 vary in height. As the matched sets 36-39 progress up the door, the hinges 40 in each matched set are a little taller than the hinges in the preceding matched set to accommodate the slight angle of the vertical track portions 31. Although each complete set 35 of roller hinges is shown to include four matched sets 36-39, it should be understood that each complete set can include more or fewer matched sets depending on the number of panels 12 forming the door 11.

The hinges 40 in each set 36-39 increase in height. Each door panel 12 typically has the same height (e.g., each panel 12 being 18 inches to 24 inches in height), and the angle of the track 31 is generally constant from top to bottom. So, the increase in height of each successive matched set (e.g., 36 to 37, of 38 to 39) is an incremental amount. This incremental increase in the height of the flanges is typically about ¼ inch. The first or bottom matched set 36 is the shortest and joins the bottom most panel 12 to the second or adjacent panel. The second matched set 37 joins the second and third panels 12. The third matched set 38 joins the third and fourth panels 12. The fourth matched set 39 joins the fourth and fifth panels.

Figure 2B:
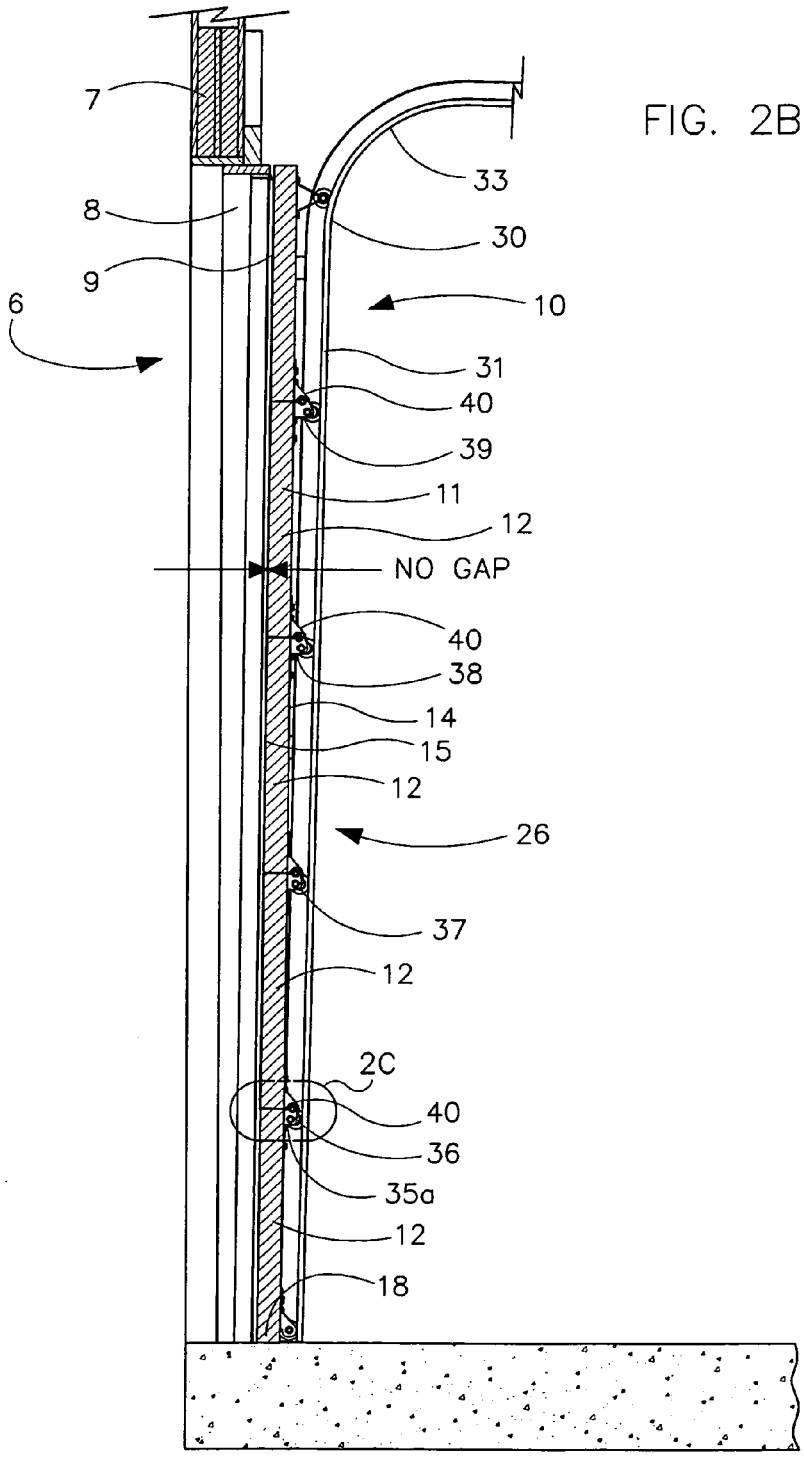
FIG. 2B is a side sectional view taken along lines 2B-2B of FIG. 2A showing one conventional top hinge, one conventional bottom hinge and each of the right-handed hinges of the four matched sets of spring-loaded roller hinges, the spring-loaded roller hinges closing the gap between the door and the framing and weather stripping on the side of the opening to seal the door against the framing and weather stripping.
Figure 3A:
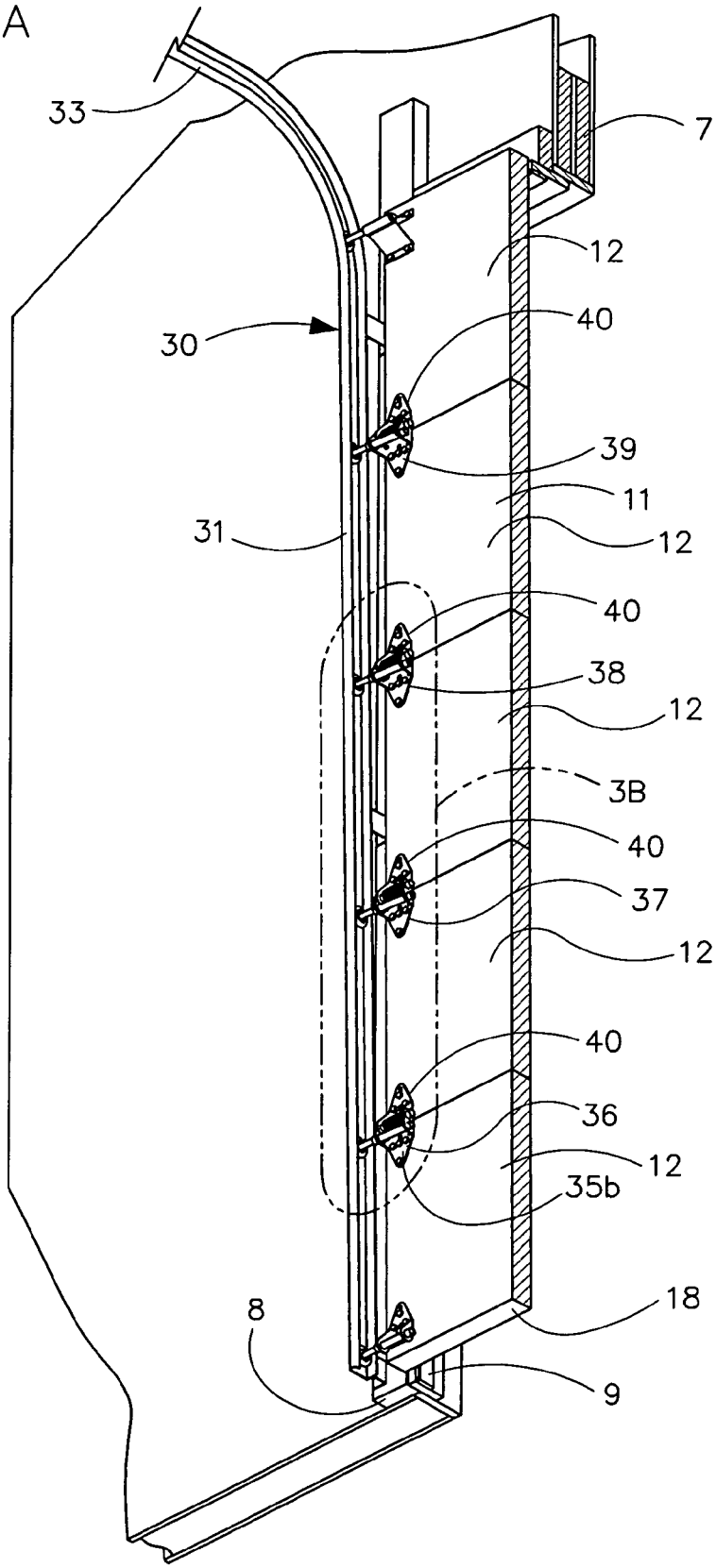
FIG. 3A is a partial perspective view of the left side of the five panel overhead door in it closed position showing a one conventional top hinge, one conventional bottom hinge and each left handed hinge of the four matched sets of spring-loaded roller hinges.

The upper ends of the top panel 12 and the lower ends of the bottom panel are fitted with conventional roller brackets suitable for the top 17 and bottom 18 of the door 11 as shown in FIGS. 2A, 2B and 3A.

The spring-loaded roller hinges 40 hingably join adjacent panels 12 together and movably secure them to the track 30. The roller hinges 40 are uniformly spaced along the sides of the door 11 as shown in FIG. 2A. A pair or matched set of roller hinges 40 pivotally joins each set of two adjacent door panels 12. One hinge 40 joins each outer end 16 of the panels 12. The total number of roller hinges 40 used for a particular door 11 depends on the number of panels 12 forming the door. The more panels 12 in the door 11, the more spring-loaded, dual-hub roller hinges 40 forming the door assembly. The dual-hub roller hinges 40 shown in FIGS. 2-7 join each set of adjacent door panels 12. As discussed below, the spring action of these spring-loaded hinges 40 seal the sides 16 of the door panels 12 against the door frame 8 or weather stripping 9 to make a more effective weather or thermal seal when the door 11 is closed 26.

Each dual hub, spring-loaded roller hinge 40 has a bracket assembly 50 formed by two mating brackets 51 and 61. Each bracket 51 and 61 has a generally flat base plate 52 or 62 that flushly engages the inside surface 14 of its door panel 12. Each base 52 and 62 is rigidly secured to one of the two adjacent panels 12 via bolts, screws or the like. Each bracket portion 51 and 61 has a set of two opposed parallel flanges 53 and 54 or 63 and 64 that extend normally and in the same direction from its flat base plate 52 or 62. Gussets 53*a* and 63*a* are provided to strengthen the flanges. An emboss 62*a* is formed in base plate 62 as discussed below.

The flanges 53 and 54 of bracket 51 are generally shorter in height and symmetrical. The flanges 63 and 64 of bracket 61 are generally longer in height and asymmetrical. Bracket 51 is slightly narrower than bracket portion 61 so its flanges 53 and 54 flushly nest between flanges 63 and 64. Flanges 53, 54, 63 and 64 are located at or near the middle of the assembled bracket 50. The brackets 51 and 61 are pivotally joined to allow the base plates 52 and 62 and adjacent door panels 12 to rotate between coplanar and angled orientations as the door 11 moves between its open 25 and closed 26 positions. The nested brackets have a width of about 2½ inches. As discussed below, each roller hinge 40 includes a roller wheel assembly that movingly and securely joins the hinge and its adjacent door panels 12 to one of the opposed tracks 30.

Each flange 53 and 54 of bracket 51 has a round hole 55 located proximal its outer end. Each flange 63 and 64 of bracket 61 has a corresponding round hole 65. Each round hole 55 and 65 has a diameter of about 0.6 inches with its center located about ¾ inch from its base plate 52 or 62. When assembled, these four holes 55 and 65 are linearly aligned to form the pivot joint or pivot centerline 65*a* of the roller hanger 40.

The inner flange 63 of the hinges 40 in matched set 36 is about the same height as flanges 53 and 54 of bracket 51. The inner flanges 63 of the hinges 40 in matched sets 37-39 are longer than the flanges 53 and 54 of bracket 51, and include a raised portion 66 that extends out further from the base plate 62 than the two shorter flanges 54 extend from their base plate 52. Each hinge 40 in matched sets 36-39 has an outer flange 64 with a longer raised portion 68 that extends even further from base plate 62 than its inner flange 63.

Each flange 63 and 64 of bracket 61 has an additional hole 67 or slot 69 located proximal its outer end. This hole 67 and slot 69 are offset a predetermined lateral distance from the hinge centerline 65*a* holes 55 and 65. The inner flange 63 of matched set 36 has a round hole 67 with a center pivot point located about ¾ inch from its base plate 62. The inner flange 63 of matched set 37 has a round hole 67 with a center pivot point located about one inch from its base plate 62. The inner flange 63 of matched set 38 has a round hole 67 with a center pivot point located about 1¼ inch from its base plate 62. The inner flange 63 of matched set 39 has a round hole 67 with a center pivot point located about 1½ inch from its base plate 62.

Figure 3B:
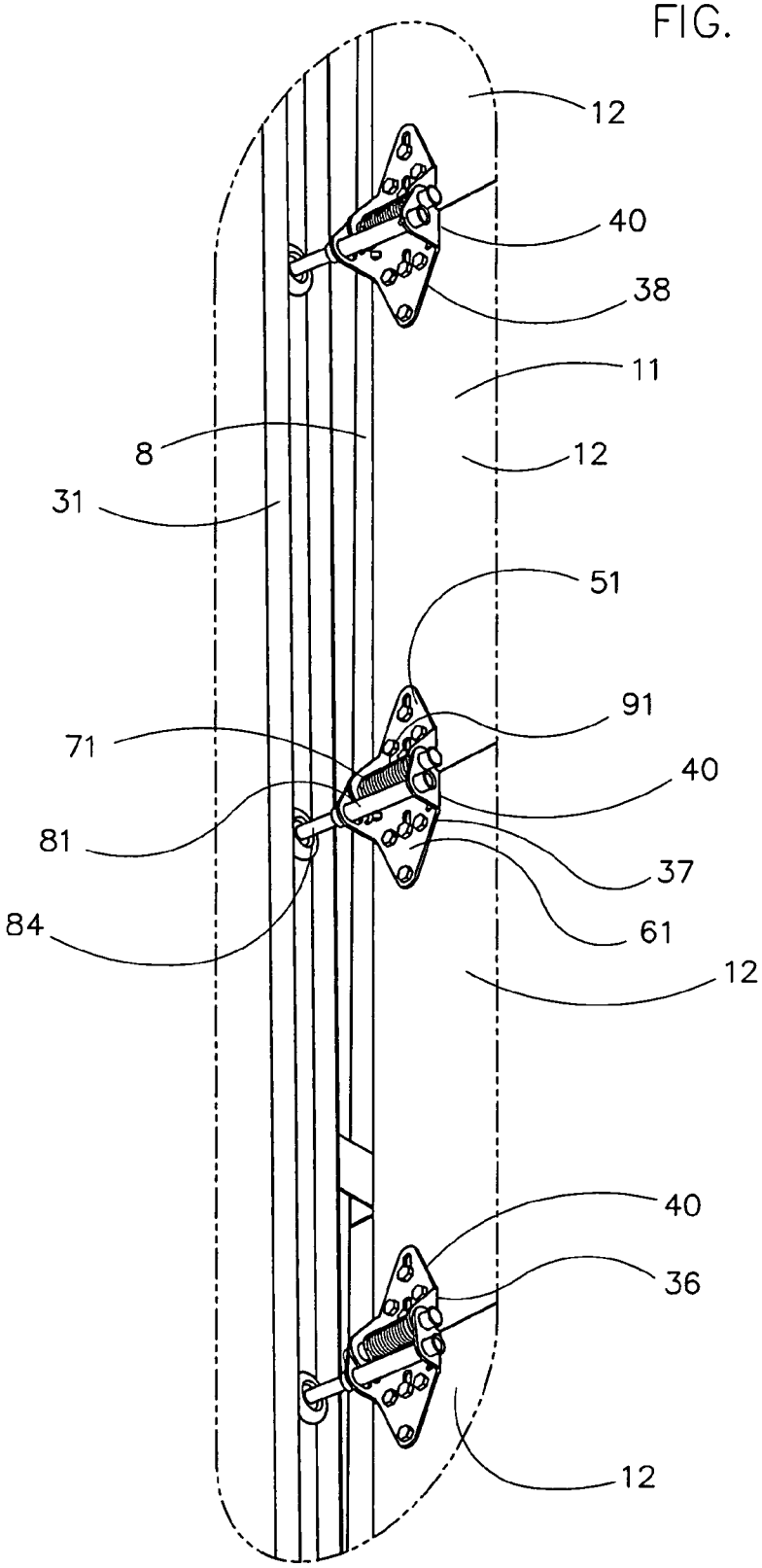
FIG. 3B is and enlarged view of three of the four spring-loaded roller hinges in FIG. 3A showing a first or lower spring-loaded roller hinge with a pivoting wheel hub positioned a first distance from its base and the door, a second or higher spring-loaded roller hinge with a pivoting wheel hub positioned a second distance from its base and the door, and a third or still higher spring-loaded roller hinge with a pivoting wheel hub positioned a third distance from its base and the door, the second and third spring-loaded roller hinges each be an incremental amount further away from their bases and the door.
Figure 7:
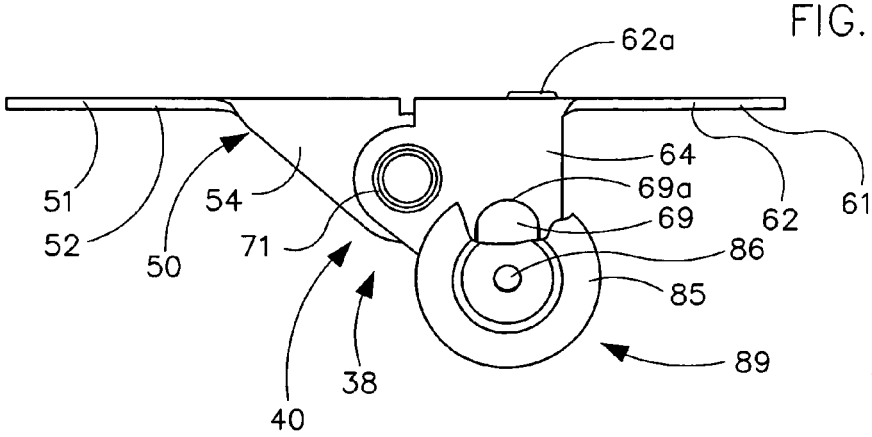
FIG. 7 is a side view of the inventive spring-loaded roller hinge with a portion of the wheel removed to show the slot in the flange.
Figure 9A:
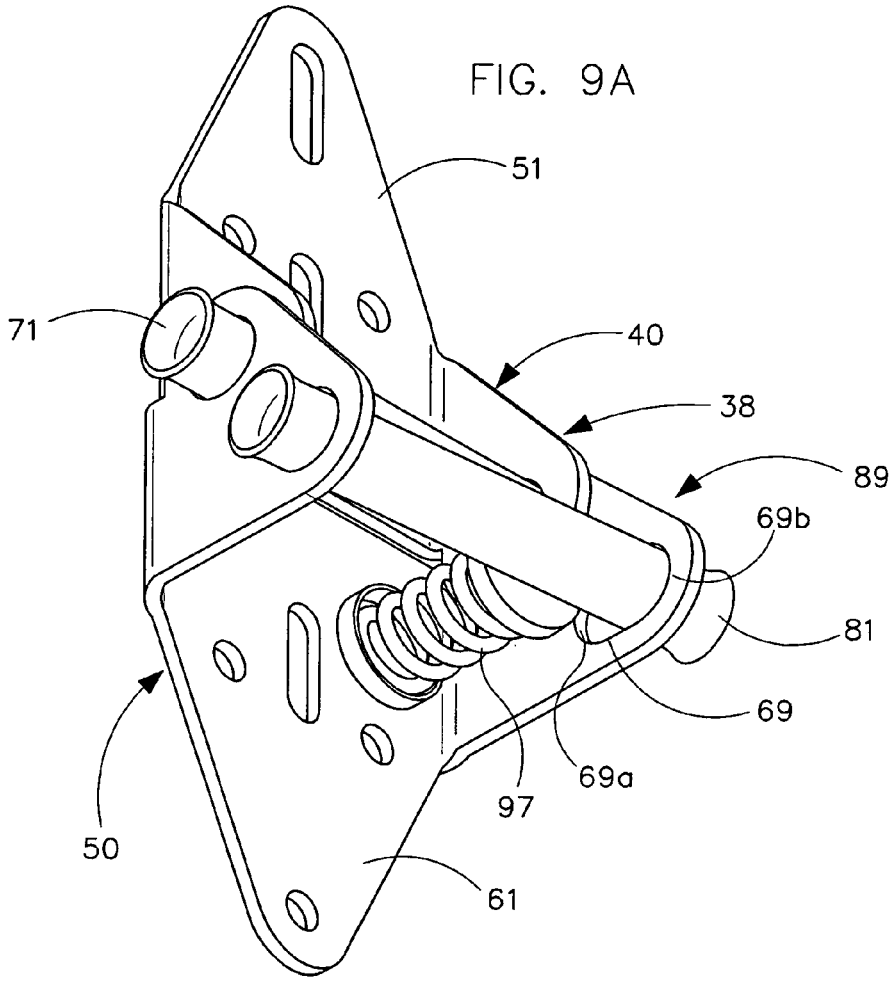
FIG. 9A is a perspective view of an alternate embodiment of the spring loaded roller hinge.
Figure 9B:
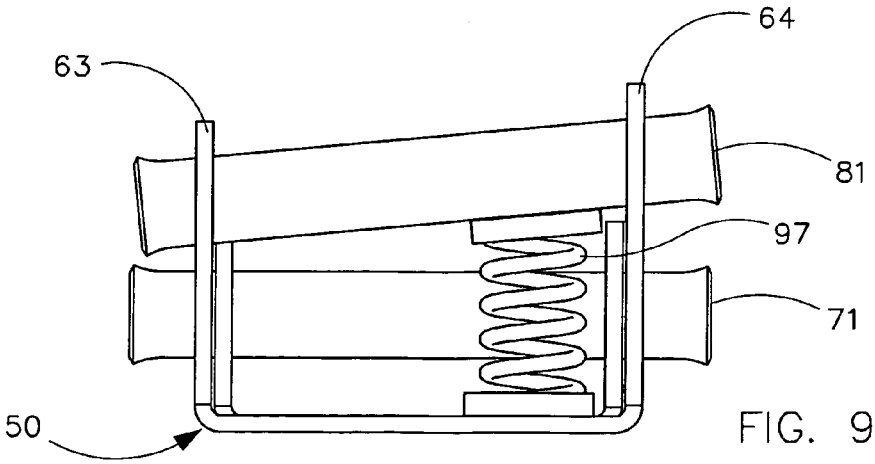
FIG. 9B is a side end view of the alternate embodiment of the spring loaded roller hinge.

The outer flange 64 has an elongated hole or slot 69 as best seen in FIGS. 3B, 7 and 9A. The slot 69 has a continuous width equal to the diameter of hole 67, and extends linearly from a location proximal the outer end of the flange 64. The length of the slot 69 is generally perpendicular to and extends outwardly from the base plate 62 of the bracket 61 and surface of its door panels 12. The slot has a working length of about ¼ inch that allows about ¼ inch of movement of its corresponding wheel hub as discussed below. The outer flange 64 with a height of about 1.8 inches (e.g., hinges in matched set 36) has a linear slot 69 length of about 0.86 inch, starting at a location about 0.72 inch from its base plate 62 and ending at a location about 1.58 inches from its base plate.

Figure 5:
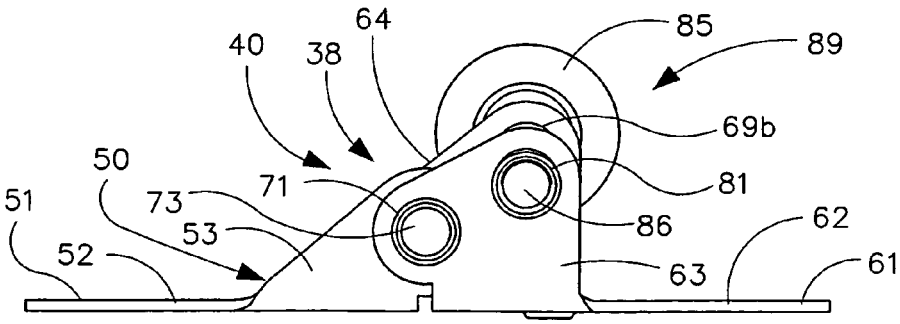
FIG. 5 is a side view of the inventive spring-loaded roller hinge with the pivoting wheel hub and wheel assembly in their fully extended position.
Figure 8A:
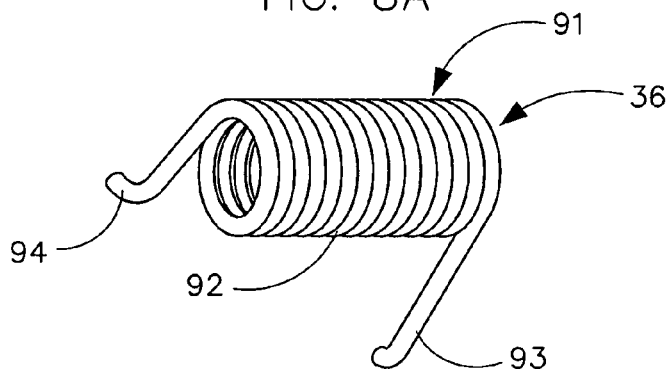
FIG. 8A is an enlarged view a torsion spring for the first set of spring-loaded roller hinges.
Figure 8B:
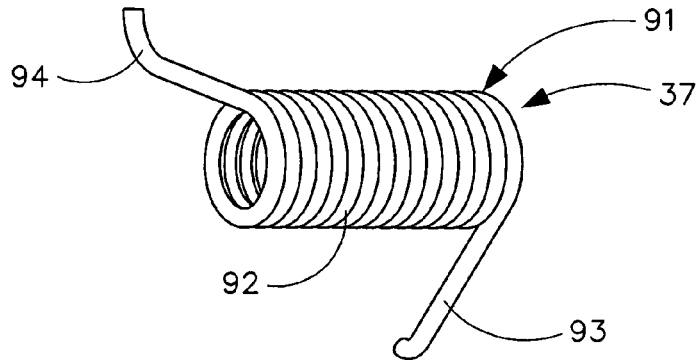
FIG. 8B is an enlarged view of a torsion spring for the second set of spring-loaded roller hinges.
Figure 8C:
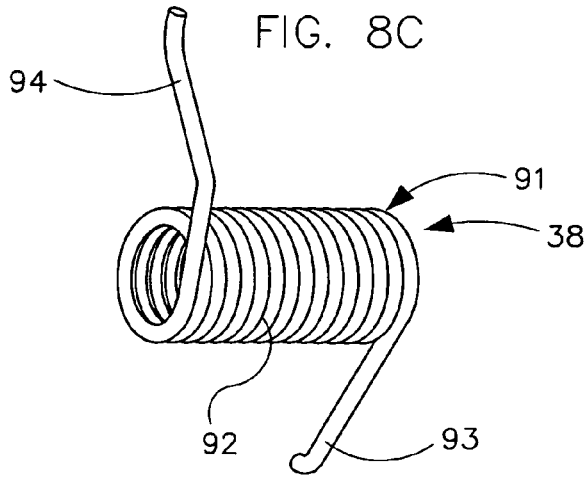
FIG. 8C is an enlarged view of a torsion spring for the third set of spring-loaded roller hinges.

A fixed hinge hub 71 forms the linear pivot joint 65*a* of each dual-hub roller hinge 40. This tubular hub 71 allows the brackets 51 and 61 and their two corresponding door panels 12 to pivot relative to each other as the door moves rotationally along the curved portions 33 of the tracks 30. The fixed hinge hub 71 is slightly longer than the brackets 51 and 61 are wide, and is snuggly received through the four round linearly aligned holes 55 and 65. The ends of the hub 71 are preferably flared to increase their diameters a slight amount and secure the hub to the nested flanges 53, 54, 63 and 64, and hingably join 65*a* the brackets 51 and 61 together. A solid metal pin 73 may be snuggly inserted into the tubular hinge hub 71 for strength as shown in FIG. 5. The pin 73 has a length about equal to the hub 71.

Figure 2C:
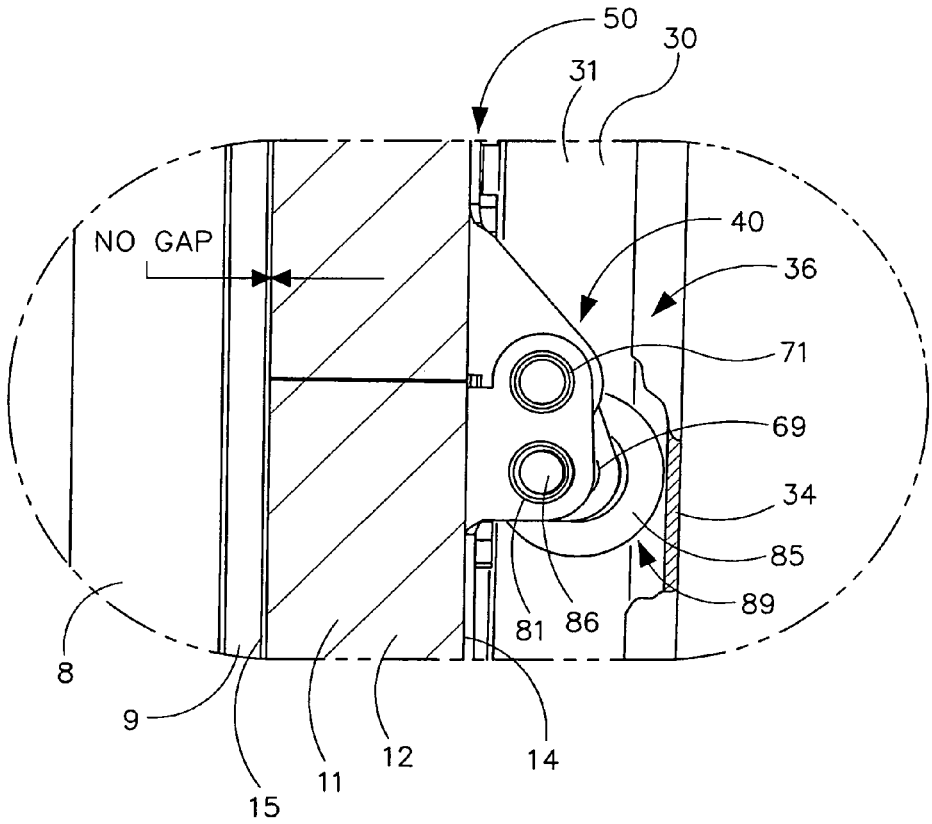
FIG. 2C is an enlarge view of one spring-loaded roller hinge of FIG. 2B showing its pivoting wheel hub pivoted in its slot to bias its corresponding wheel axle and roller wheel rearwardly, the roller wheel being secured in its track with the wheel pushing against the inner or rearward end of the track to resiliently push the adjacent panels of the door forward and toward the framing on the side of the opening to close and seal the gap between the door and the framing and its weather striping.
Figure 2D:
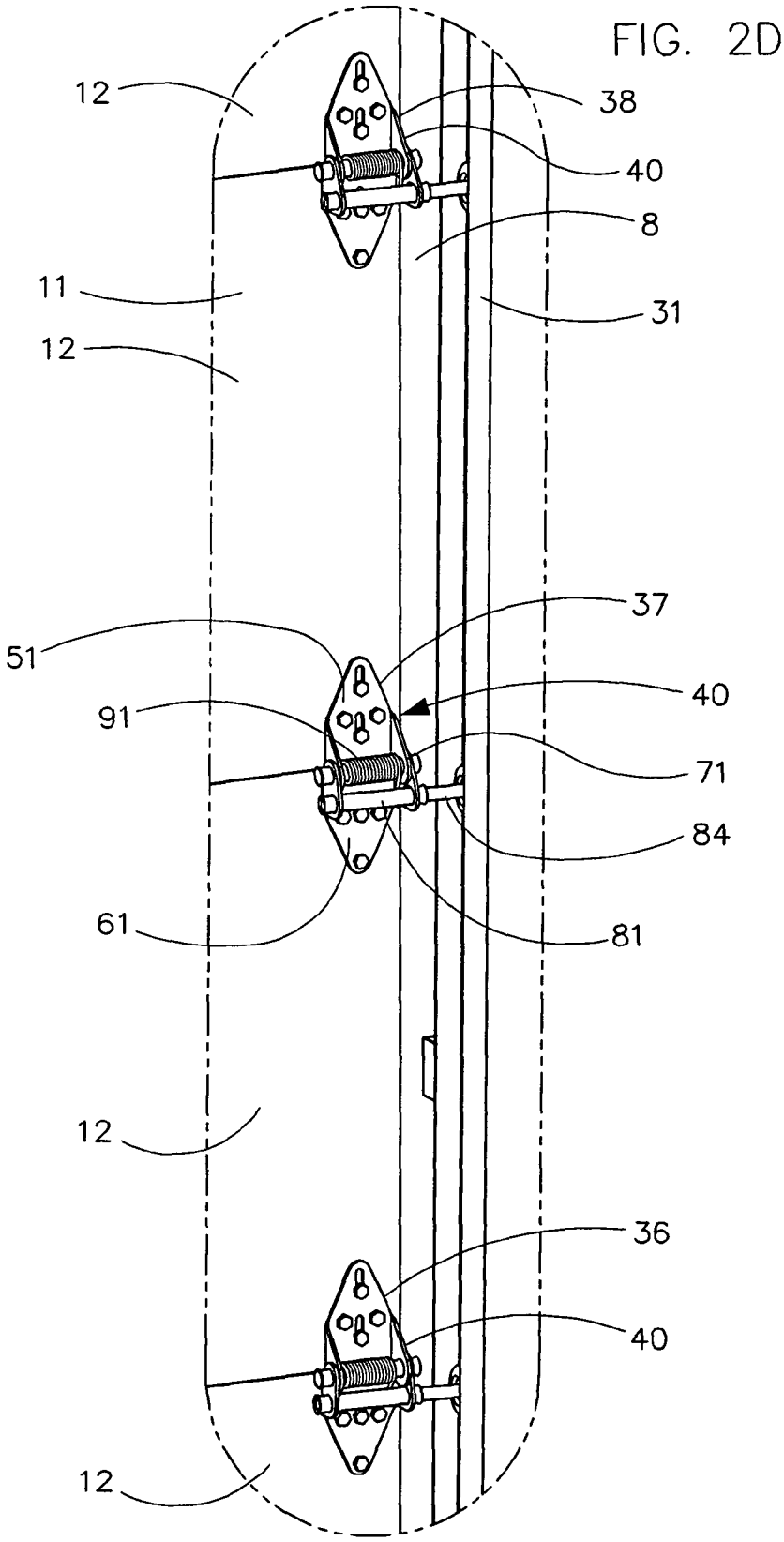
FIG. 2D is and enlarged view of three of the four spring-loaded roller hinges in FIG. 2A showing a first or lower spring-loaded roller hinge with a pivoting wheel hub positioned a first distance from its base and the door, a second or higher spring-loaded roller hinge with a pivoting wheel hub positioned a second distance from its base and the door, and a third or still higher spring-loaded roller hinge with a pivoting wheel hub positioned a third distance from its base and the door, the second and third spring-loaded roller hinges each be an incremental amount further away from their bases and the door.
Figure 6:
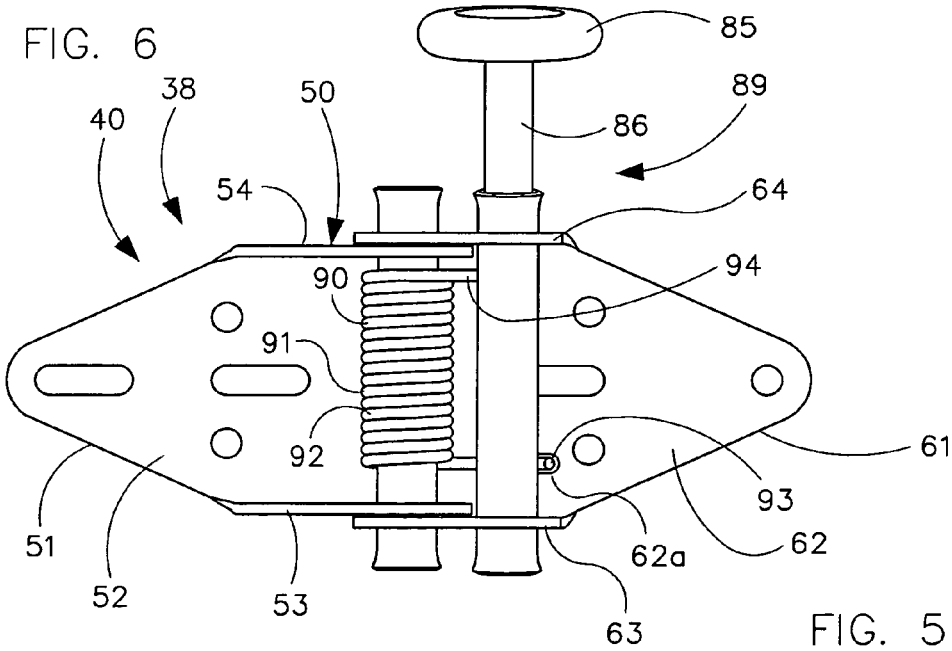
FIG. 6 is a top view of the inventive spring-loaded roller hinge.

A pivotable wheel hub 81 is spaced from the hinge hub 71 a lateral distance of about one inch as best shown in FIGS. 2C and 6. The wheel hub 81 is aligned in a generally planar or spaced parallel relationship to the hinge hub 71. The wheel hub 81 is also tubular in shape, and about the same length as hinge hub 71. The pivotable wheel hub 81 is received through hole 67 and slot 69 of flanges 63 and 64. The ends of the hub 81 are similarly flared to secure the hub to the nested flanges 63 and 64. The diameter of hole 67 and slot 69 is a few thousands of an inch wider than the diameter of the wheel hub 81 to create a flush but loose fit that allows the wheel hub to slide lengthwise a small amount relative to its flanges 63 and 64 between its flared ends. The loose fit of the hub 81 combines with the round hole 67 to allow the hub to pivot in the hole about a pivot point 67*a* corresponding to the center of the hole 67.

A roller wheel assembly 84 having a wheel 85 and an axle 86 is secured to the pivotable wheel hub 81. The wheel 85 is rotatably attached to its axle 86, and preferably via ball bearings. The wheel axle 86 has a length of about 4½ inches, and is longer than the wheel hub 81 and width of the bracket 50 as seen in FIGS. 2D, 3B and 4A-C. The metal axle 86 is flushly received by the tubular wheel hub 81. The wheel axle 86 is free to slide laterally inside the hub 81 to accommodate any anomalies in spacing of the tracks 30 when they are secured to the building 5. The wheel 85 is generally located about 1 to 1¼ inches out from the outer flange 64 of the bracket 50 with its diameter generally parallel to the flange of the bracket. An inner end 34 of each track 30 prevents the wheels 85 from moving away from the opening 6 when a hinge 40 and its adjacent door panels 12 are on the vertical track portions 31 such as when the door 11 is in its closed position 26. Thus, the wheels 85 remain substantially horizontally fixed relative to the fixed track 30 and door opening 6, while the brackets 50 and door panels 12 move toward the fixed frame 8 and door opening 6.

The pivot hole 67 and slot 69 allow the wheel hub 81, axle 86 and wheel 85 to move through a range of motion relative to the base 62 of the bracket 50 and its adjacent door panels 12. The wheel hub 81 pivots toward and away from its base plate 62 between an inward or forward extending position 88 where the hub engages the innermost end 69*a* of the slot as in FIG. 4A, and an outward or rearward extending position 89 where the hub 81 engages the outermost end 69*b* of the slot 69 as in FIG. 4B. The pivoting wheel hub 81 has a continuous range of motion between positions 88 and 89, including intermediate positions such as in FIG. 4C. In the preferred embodiment, the slot 69 has a working length of about ¼ inch. In this embodiment, the wheel hub 81 and axle 86 are generally parallel to the base 62 and hinge hub 71 (about 0° angle) when in its forward position 88, and are about 5° out of parallel with the base and hub 71 (in direction away from door 11) when in its rearward position 89. Conventional tracks 30 with C-shaped cross sections accommodate these angular wheel 85 orientations.

Figure 4A:
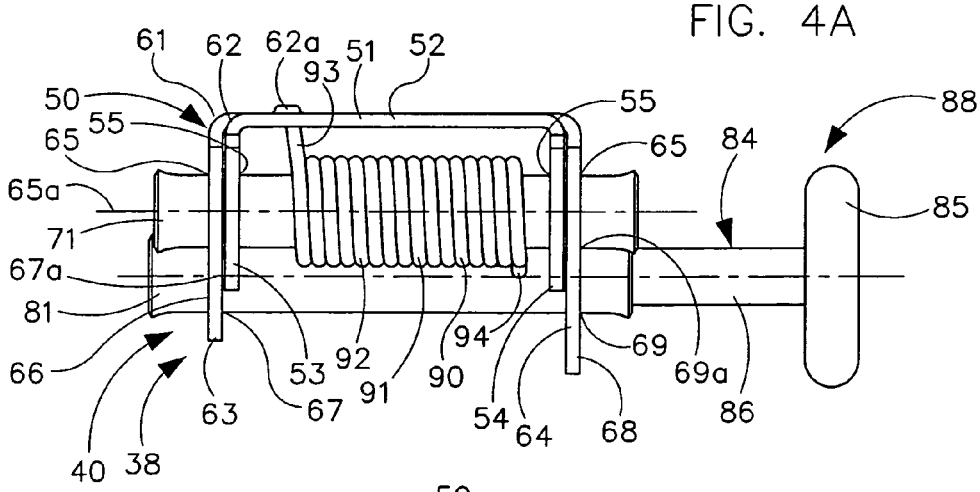
FIG. 4A is a side view of a right-handed, spring-loaded roller hinge showing the mating relationship of the side flanges hingably joined by a fixed hinge hub, and the taller side flanges of one bracket holding the pivoting wheel hub and its corresponding wheel assembly, with a torsion spring coiled about the fixed hinge hub with one of the spring legs engaging the hinge base and the other spring leg engaging the pivoting wheel hub, and where the pivoting wheel hub is in its innermost angled position where its movable end engages the innermost end of the slot in the tallest hinge flange.
Figure 4B:
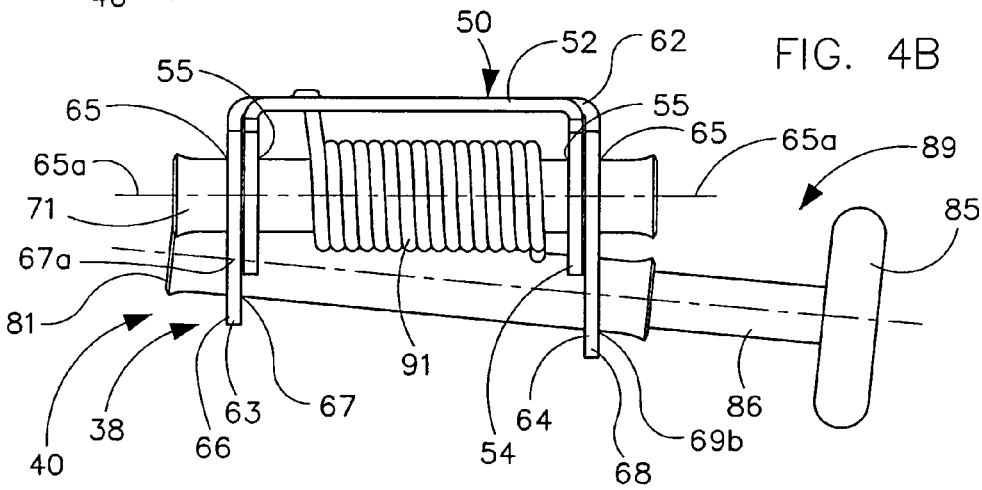
FIG. 4B is a side view of a right-handed, spring-loaded roller hinge showing the pivoting wheel hub in its outermost angled position where its movable end engages the outermost end of the slot in the tallest hinge flange, the one leg of the torsion spring engaging and being held by an emboss in the hinge base.
Figure 4C:
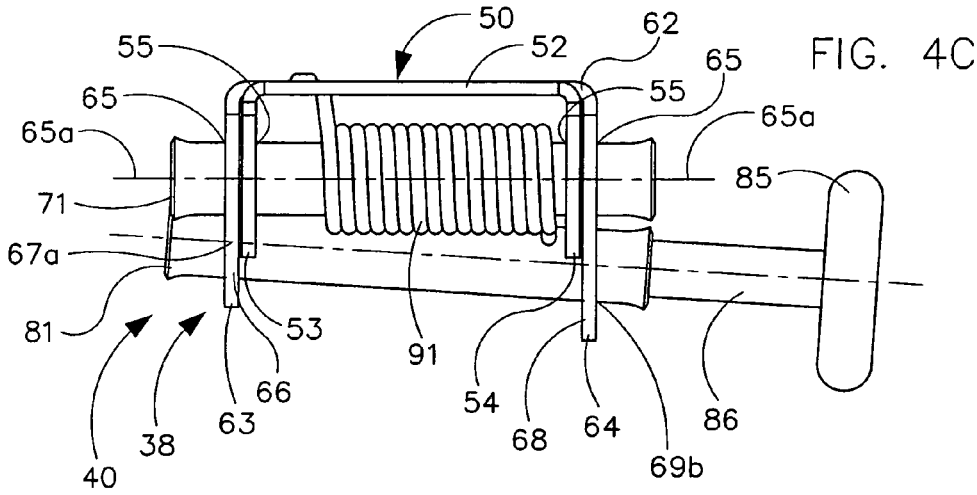
FIG. 4C is a side view of a right-handed, spring-loaded roller hinge showing the pivoting wheel hub in an intermediate position where its movable end is between the innermost and outermost ends of the slot in the tallest hinge flange, and showing the torsion spring slid to a second position to produce a maximum amount of resilient pushing force on the movable end of the pivoting wheel hub and its corresponding wheel.

A biasing mechanism 90 such as a spring biases the wheel hub 81 into its outward or rearward position 89 as in FIG. 4B. The biasing mechanism 90 is positioned between the base plate 62 of bracket 61 and the outer or movable end of wheel hub 81. The biasing mechanism 90 is preferably located to push on the outer or movable end of the wheel hub 81 just inside flange 64 to produce an effective force to bias the wheel hub rearwardly and toward engagement with the outer end of the slot 60, and thereby bias the bracket 50 and door panels 12 forward toward the side frame 8 of the building to create an effective seal.

Biased movement of the pivoting wheel hub 81 from a forward position 88 engaging the innermost end 69*a* of the slot 69 as in FIG. 4A to a rearward position 89 engaging the outermost end 69*b* of the slot as in FIG. 4B, moves the bracket 50 and door panels 12 from a rearward position to a forward position to close any gap between the door panels and the framing 8 and weather striping 9 on the side of the opening 6 as in FIG. 2B. In other words, the pivoting movement of the wheel hub 81 causes the bracket 50 and sides 16 of the door panels 12 to move forward and into engagement with the side framing 8 or weather stripping 9 for the door frame 7. An opposite pivoting movement of the wheel hub 81 causes the door panels 12 and bracket 50 to move rearward or toward the interior of the building 5. Because the wheel 85 is outwardly cantilevered from the side of the bracket 50, a slot 69 length of about ¼ inch, produces a bracket 50 range of movement of up to about ½ inch.

The biasing mechanism 90 is preferably a pre-loaded torsion spring 91 as shown in FIGS. 2-8. The torsion spring 92 has a coil section 92 with a length of about 1¾ inch and an inside diameter of about ⅞ inch to allow the coil section to be snugly positioned around the hinge hub 71. The coil spring 91 has pendent legs 93 and 94 extending from opposite sides of the coil section 92. One leg 93 engages and pushes against the base plate 62. This leg 93 is located proximal the inner or pivot point end of the bracket 50. The other leg 94 engages and pushes against the wheel hub 81. This leg 94 is located proximal the movable end of the wheel hub 81 or the slot end of the bracket 50. The length of the spring leg 94 increases with the increasing height of the flange 64 of matched sets 36-39 as shown in FIGS. 8A-C. The legs 93 and 94 of each spring are rotated toward each other when place in the hinges 40 to preload the spring 91. Each torsion spring 91 continuously produces a resilient pushing force between the wheel hub 81 and bracket base plate 62. This spring force pushes the wheel 85 against the fixed inner end 34 of the track 30, which in turn directly presses the adjacent door panels 12 against the frame 8 or weather stripping 9 along the side of the door opening 6. The force of the wheel 85 against the fixed inner end 34 of the track 30 is preferably between about 5 to 23 pounds, and more preferably between about 8 and 18 pounds and most preferably about 12 pounds. The force of the wheel 85 acting on the track 30 is the same force the door pushes against the frame 8 or weather striping 9.

A simple force adjusting mechanism allows for selective adjustment of the force pushing the door against the frame 8 or weather striping 9 along the door opening 6. The length of the coil section 92 is shorter than the width of the bracket 50. Thus, the spring 91 can slide along hinge hub 71 so that the leg 94 engaging the wheel hub 81 moves toward or away from the outer or movable end of the wheel hub 81. The force of the spring 91 on the outer end of the wheel hub 81 increases by sliding the coil potion 92 and leg 94 toward the outer end of hubs 71 and 81, which in turn increases the pushing force of the door panels 12 on the frame 8 or weather stripping 9. The force of the spring 91 on the on the outer end of the wheel hub 81 decreases by sliding the coil portion 92 and leg 94 away from the outer end of the hubs, which in turn decreases the pushing force of the door panels 12 on the frame 8 or weather stripping 9. The emboss 62*a* in the base plate 62 provides an abutment for securing the leg 93 to the base plate in a desired force producing position as shown in FIGS. 4-7. Although only one emboss is shown, it should be understood that several embosses could be provides.

During operation, the door can be raised to its fully open, overhead position 25. When fully open, the door 11 is on the horizontal portions 32 of the track 30, and the weight of the door is supported by the spring-loaded roller hinges 40 and their wheel assemblies 84. The weight of most doors 11 overcomes the pushing force of the springs 91 so that each wheel hub 81 rests on the innermost portion 69*a* of its slot 69. The spring-loaded roller hinges 40 bottom out so that they are in their forward position 88 as in FIG. 4A. When the door 11 is closing, the door travels around the curved sections 33 of the track 30 and onto its vertical sections 31. As this occurs, the door 11 moves from a horizontal orientation to a vertical orientation, and the weight of the door is released from compressing the springs 92. As this occurs, the springs 92 bias the wheel hubs 81 to their rearward position 89 as in FIG. 4B. The adjacent panels 12 of the door 11 are being resiliently pushed forward about ⅜ inch by the spring-loaded roller hinges 40.

As the door 11 travels down the slightly angled, vertical portions 31 of the track 30, and begins to approach its closed position 26, the front side surfaces 15, 16 of the door begin to engage the framing 8 or weather stripping 9 along the sides of the opening. Should this engagement produce a force more than the set pushing force of the springs 92, the wheel hub 81 pivots forward to an intermediate position such as in FIG. 4C. During operation, the wheel hubs 81 preferably remain at or near their rearward position 89 as in FIG. 4B when the door 11 is in its closed position 26. While warping of the side framing 8, deterioration in some portions of the weather stripping 9 are accommodated by the spring-loaded roller hinges 40, other areas of the framing and weather stripping do not require accommodation by the roller hinges. Just as with a conventional overhead door assembly, to avoid binding between the door 11 and its side frame 8 when the door 11 is traveling on the vertical track portions 31, bottoming out of the wheel hubs 40 as in FIG. 4A should be avoided.

Alternate embodiments of the biasing mechanism 90 and hinges 40 are shown in FIGS. 9A, 9B, 10A and 10B. The biasing mechanism 90 takes the form of a cylindrical helical coil spring 97 with its length running parallel to linear slot 69 as in FIGS. 9A and 9B. For a conventional overhead door assembly 10, each spring 91 preferably has a non-compressed length of about one inch and produces 5 to 23 pounds of pushing force between the wheel hub 81 and door panel 11, which in turn directly presses the door panel 11 against the door jam or frame 7.

Figure 10A:
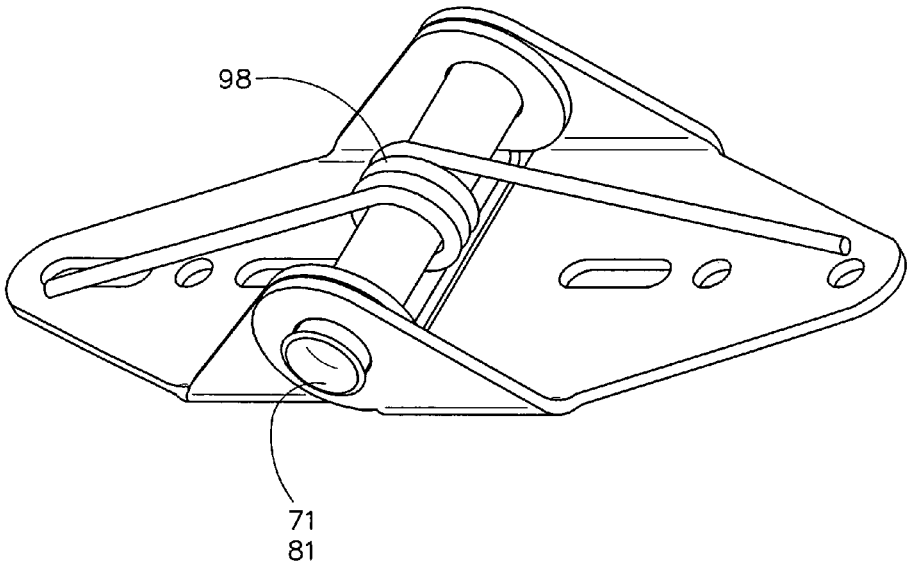
FIG. 10A is a perspective view of an additional alternate, low-profile embodiment of the spring loaded roller hinge.
Figure 10B:
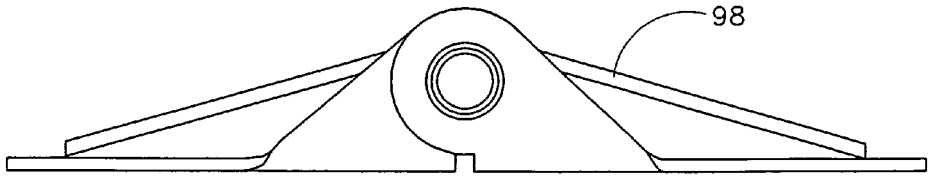
FIG. 10B is a side end view of the additional alternate, low-profile embodiment of the spring loaded roller hinge.
Figure 11:
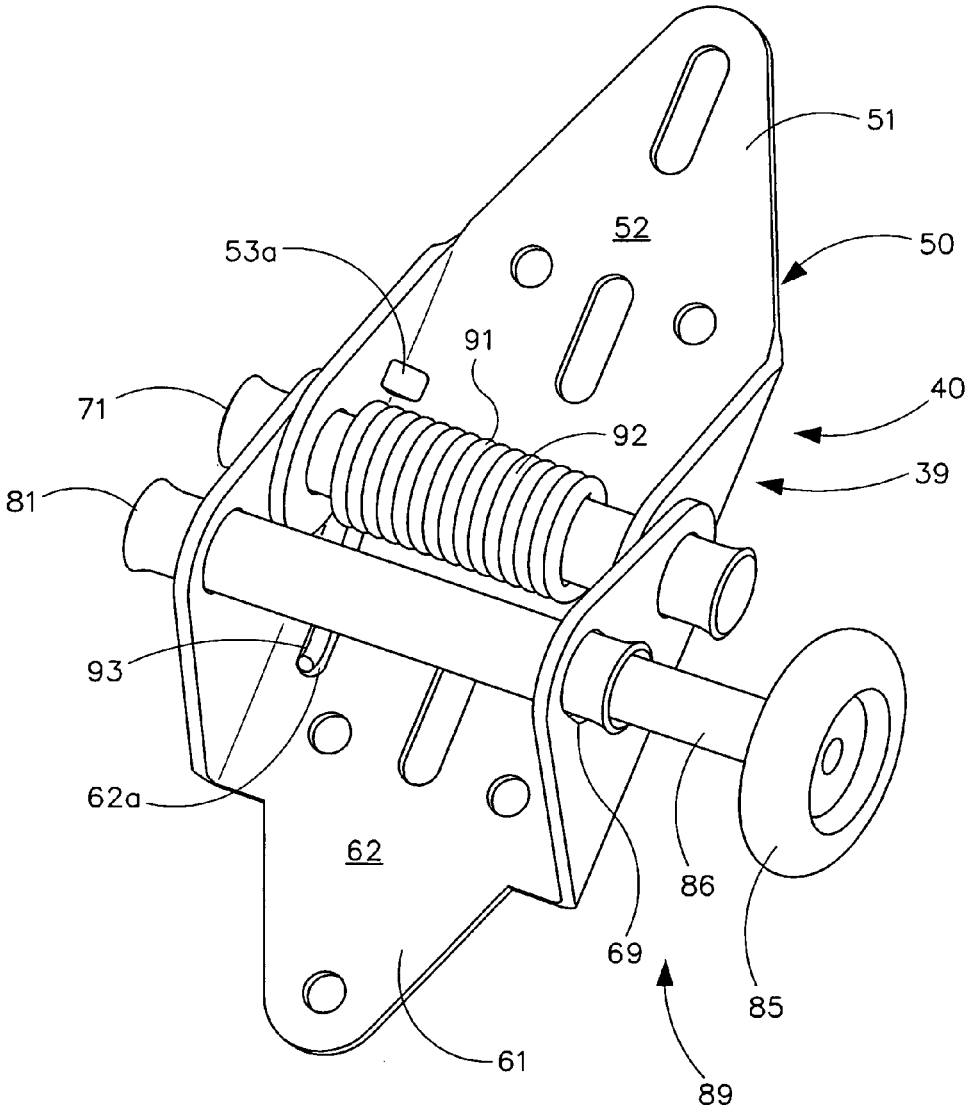
FIG. 11 is a perspective view of the spring loaded hinge of the present invention.
Figure 12:
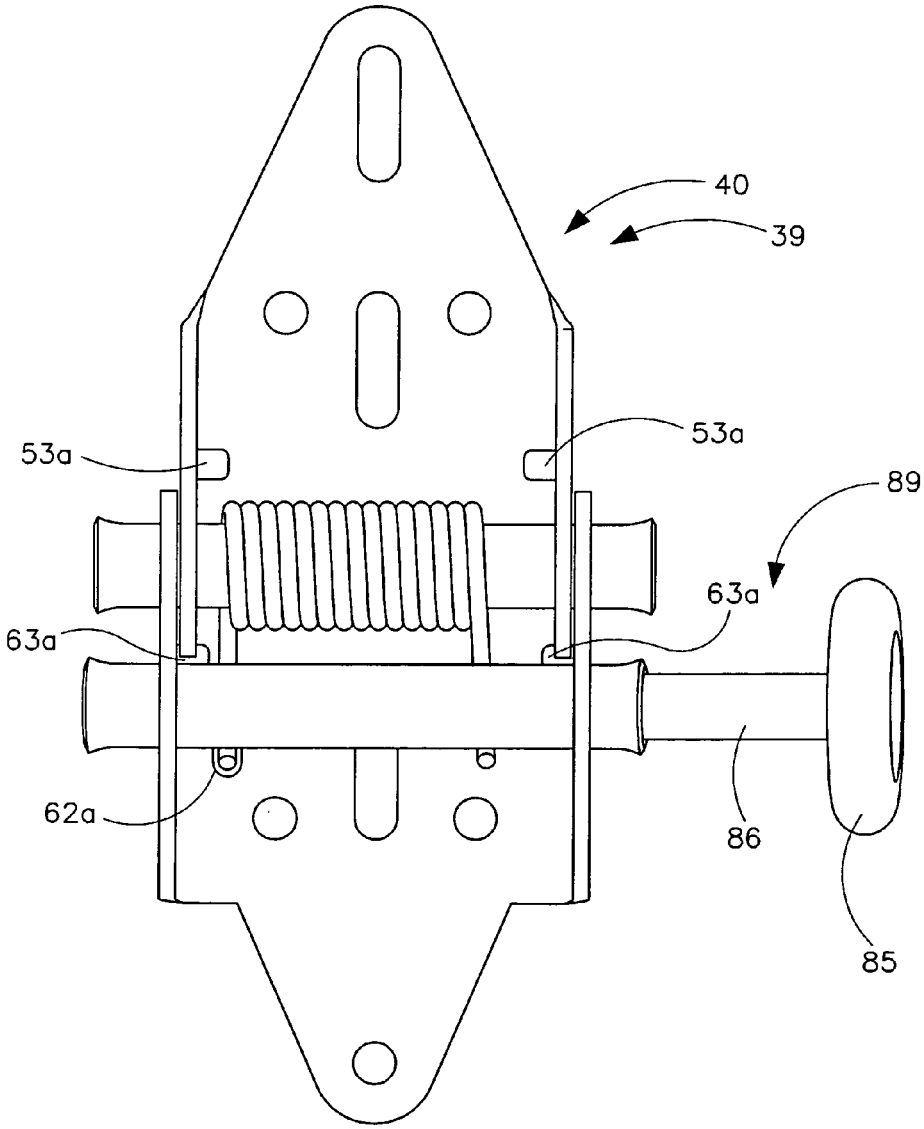
FIG. 12 is a top view of the spring loaded hinge.
Figure 13:
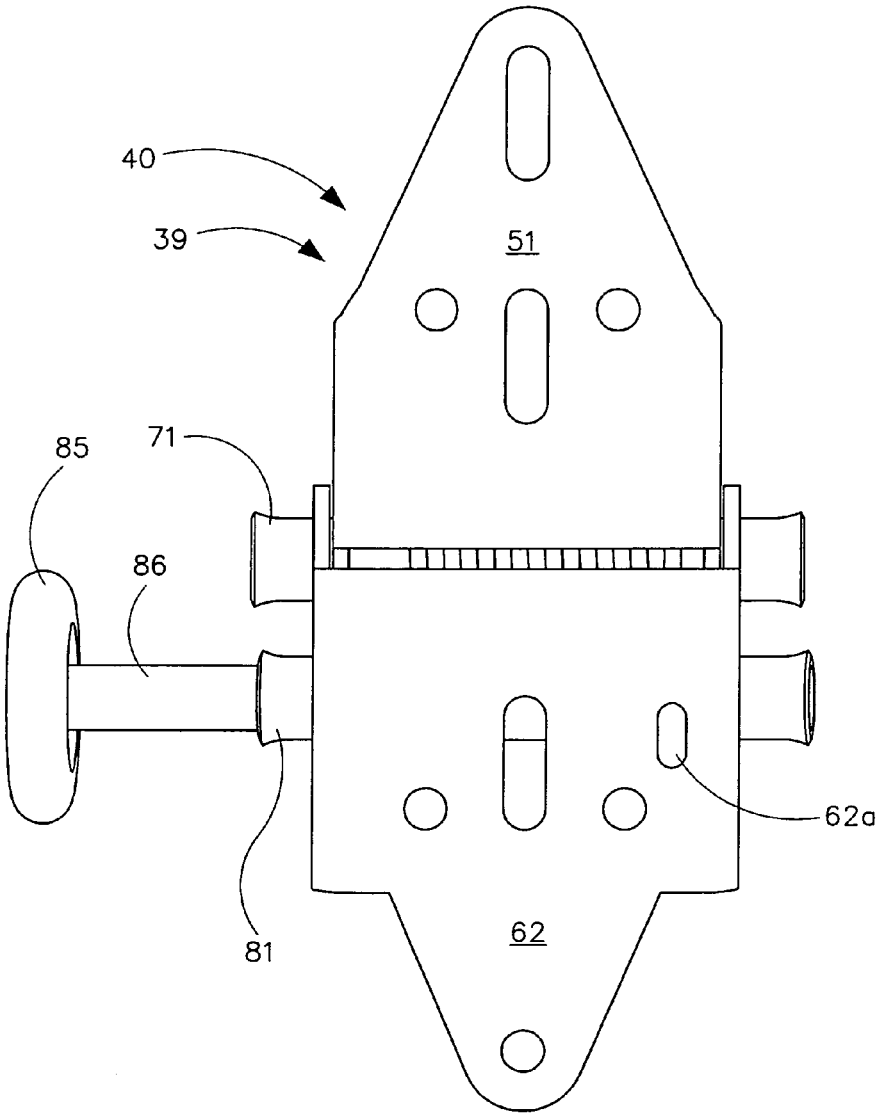
FIG. 13 is a bottom view of the spring loaded hinge.
Figure 14:
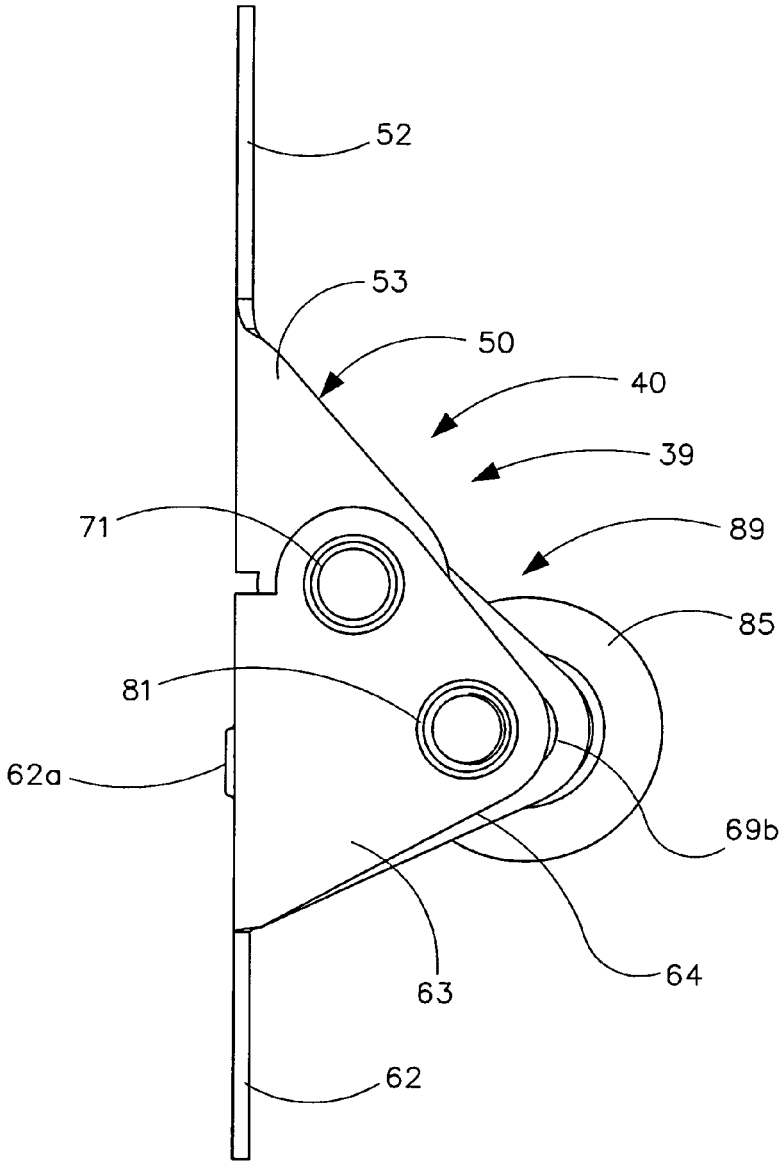
FIG. 14 is a side view of the spring loaded hinge.
Figure 15:
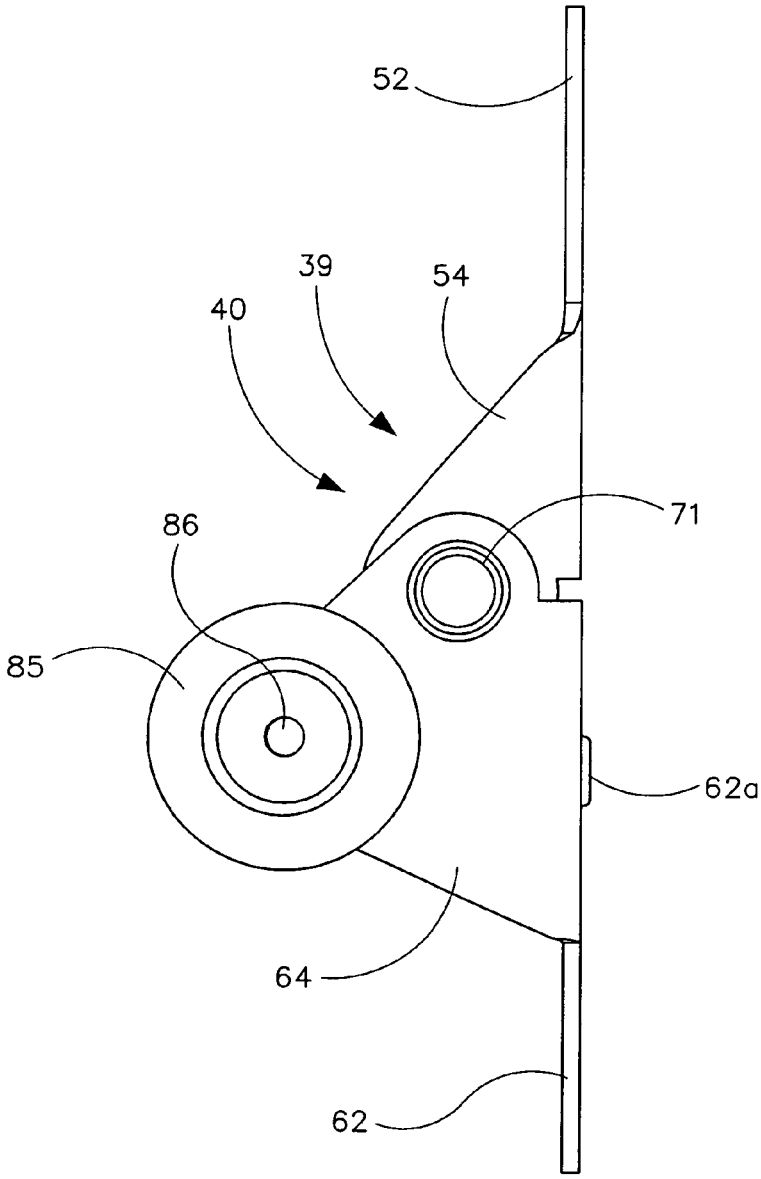
FIG. 15 is an opposed side view of the spring loaded hinge.
Figure 16:
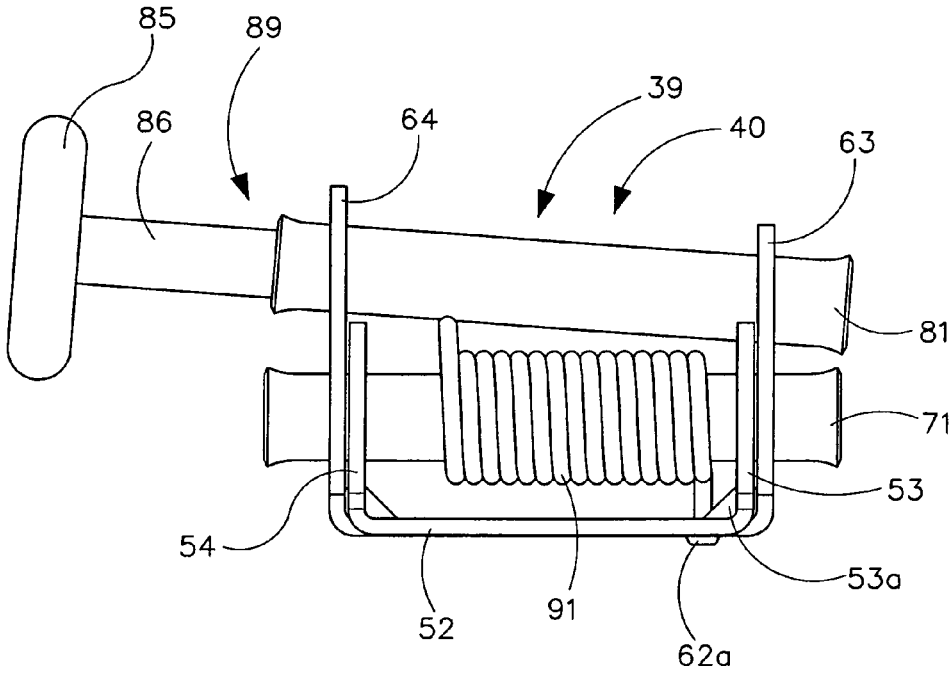
FIG. 16 is a side end view of the spring loaded hinge.
Figure 17:
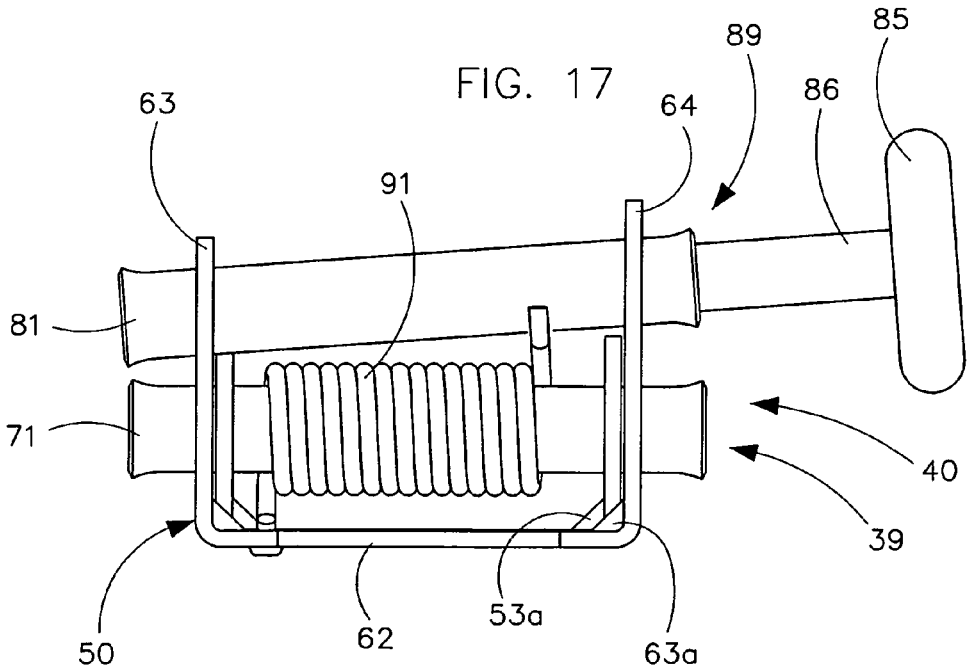
FIG. 17 is an opposed side end view of the spring loaded hinge.

An alternate form of the hinges 40 forming the bottom or shortest matched set 36 take the form of a single hub, spring-loaded roller hinge 140 is shown in FIGS. 10A and 10B. Each bracket portion 151 and 161 has two opposed flanges 153 and 154 or 163 and 164 located at or near the middle of the assembled roller bracket 150.

While the invention has been described with reference to a preferred embodiment, it will be understood by those skilled in the art that various changes may be made and equivalents may be substituted without departing from the broader aspects of the invention.

I claim:

1. An overhead door assembly for selectively closing and sealing an opening in a building with framing located along the sides of the opening, the overhead door assembly comprising:

a multi-panel door with opposed sides and formed by a plurality of panels aligned in substantially flush registered alignment to form sets of adjacent door panels, each said panel having a length sufficient to span said opening;

a dual track assembly formed by opposed tracks, each said track having a substantially vertical track portion fixed to the framing on one of said sides of the opening, said dual track assembly guiding and allowing selective movement of said door between open and closed positions, each said vertical track portion having an inner end, and said vertical track portions being spaced from said framing to create a gap between said panels and said framing when said door is in said closed position;

a plurality of wheel assemblies, each assembly including a wheel and a wheel axle, each said wheel being movably and guidably held by one of said tracks, said inner end of said vertical track portions preventing said wheels from moving away from the opening when said door is in said closed position;

a plurality of spring-loaded roller hinges positioned proximal said sides of said door, each spring-loaded roller hinge including pivotally joined brackets, each bracket having a base firmly secured to one of said adjacent door panels to allow hinged movement between said adjacent door panels, one bracket of said brackets having inner and outer spaced apart flanges holding and supporting a pivoting wheel hub, said inner flange having a hole sized to flushly receive a pivot end of said wheel hub, said wheel hub pivoting about a pivot point corresponding to said hole, said outer flange having an elongated slot sized to flushly receive and movingly guide a movable end of said pivoting wheel hub, said slot having an innermost end and a length extending away from said base to an outermost end, each said wheel hub receiving and holding one said wheel axle, said wheel axle extending from said movable end of said wheel hub toward its said track with its said wheel engaging its said track;

each spring-loaded roller hinge including a preloaded biasing mechanism, said biasing mechanism engaging said pivoting wheel hub to resiliently bias its said movable end toward said outermost end of said slot; and, wherein each of said preloaded biasing mechanisms resiliently pushes its said wheel against said inner end of its said vertical track portion to resiliently push its said adjacent door panels toward the framing to close said gap and seal the door when said door is in said closed position.

2. The overhead door assembly of claim 1, and wherein said wheel hub is pivotable through a range of motion between fully extended and fully retracted positions, said range of motion allowing said movable end of said wheel hub to move about ¼ inch and said hinge to close said gap, said gap being up to about ½ inch.

3. The overhead door assembly of claim 2, and wherein said biasing mechanism is a preloaded spring with opposed ends, said spring engaging said one base at one end and said wheel hub at said other end to biasingly push said movable end of said pivoting wheel hub away from said hinge base.

4. The overhead door assembly of claim 2, and wherein said brackets of each spring loaded roller hinge are pivotally joined by a fixed hinge hub spaced from said bases of said brackets, and wherein said biasing mechanism is a preloaded torsion spring producing a continuous and resilient pushing force, said torsion spring having a coiled section and first and second legs, said coiled section being coiled around said fixed hinge hub, said first leg extending into continuous forced engagement with said hinge base, and said second leg extending into continuous forced engagement with said pivoting wheel hub.

5. The overhead door assembly of claim 4, and wherein each said wheel pushes against its said inner end of said track with a pushing force of between about 5 to 23 pounds, and further including a force adjusting mechanism to adjust said pushing force, said force adjusting mechanism including at least one abutment in said base of said one bracket for engaging said first leg of said torsion spring, and said coil section of said spring being slidable along said fixed hinge hub between lower and higher force producing positions, said second leg engaging said pivoting wheel hub away from its said movable end when in said lower force producing position, and said first leg engaging said recess and said second leg engaging said pivoting wheel hub proximal its said movable end when in said higher force producing position.

6. The overhead door assembly of claim 4, and wherein said substantially vertical track portions are at a slight angle away from said framing, said upper ends of said vertical track portions being slightly further away from said framing than said lower ends of said vertical track portions;

said plurality of spring-loaded roller hinges including at least first, second and third matched sets of spring-loaded roller hinges;

each spring-loaded roller hinge in said first matched set having flanges of sufficient length to locate its said pivoting wheel hub a first predetermined distance from its said base plate;

each spring-loaded roller hinge in said second matched set having flanges of sufficient length to locate its said pivoting wheel hub a second predetermined distance from its said base plate, said second predetermined distance being an incremental amount greater than said first predetermined distance; and, each spring-loaded roller hinge in said third matched set having flanges of sufficient length to locate said pivoting wheel hub a third predetermined distance from its said base plate, said third predetermined distance being said incremental amount greater than said second predetermined distance.

7. The overhead door assembly of claim 6, and wherein each said panel has a height of about 24 inches, said angle of said substantially vertical track portions relative to said framing is about ½ to 1 degree, and said incremental amount is about ¼ inch.

8. The overhead door assembly of claim 6, and wherein each hinge hub of said spring-loaded roller hinges has a hinge hub center line located about ¾ of an inch from its base plate, said pivot point of each of said first matched set of spring-loaded roller hinges is located about ¾ inch from its said base plate, said pivot point of each of said second matched set of spring-loaded roller hinges is located about 1 inch from its said base plate, said pivot point of each of said third matched set of spring-loaded roller hinges is located about 1¼ inch from its said base plate.

9. The overhead door assembly of claim 1, and wherein each said each of said tracks of said dual track assembly has a substantially horizontal track portion joined to its said substantially vertical track portion by a curved track portion, and said door being in said closed position when selectively moved to and positioned on said vertical track portions, and in said open position when positioned on said horizontal track portions; and, wherein each of said tracks has a inwardly facing C-shaped cross section with uniformly spaced sides to substantially prevent sideward movement of said wheel relative to said track while allowing said wheels to move along said track, said C-shaped cross section being sized to prevent substantial inward and outward movement of said wheels relative to the building opening when said door is in said closed position.

10. The overhead door assembly of claim 1, and wherein the opening in the building is a garage door opening, and the framing along the side of the opening includes weather stripping extending into the building, and wherein said door panels have sufficient length to span the opening and overlap with the framing and weather stripping extending into the building.

11. The overhead door assembly of claim 1, and wherein the opening in the building is a garage door opening, and the framing along the side of the opening includes weather stripping extending into the opening, and wherein said door panels have sufficient length to span the opening and overlap with the weather stripping extending into the opening without said door panels engaging the framing along the side of the opening.

12. A spring-loaded roller hinge for an overhead door assembly, the overhead door assembly including a multi-panel door movingly held by opposed tracks and wheel assemblies, each wheel assembly including a wheel rotatably joined by an axle, the wheel being rollingly received and guidably held by the track, each track having a substantially vertical track portion fixed to one opposed substantially vertical framing located along the sides of the opening, the tracks and wheel assemblies guiding and allowing selective movement of the door between open and closed positions, the door including a series of adjacent panels, each panel spanning the width of the opening and overlapping the framing, and each vertical track portion having an inner end against which the wheels can push, said spring-loaded roller hinge comprising:

a first bracket having a first base plate and first and second side flanges, said first and second flanges extending substantially perpendicular to said base plate in a common direction;

a second bracket aligned in mating relationship with said first bracket, said second bracket having a second base plate and third and fourth side flanges, said base plates being in substantially planar alignment, and said third and fourth flanges extending from said second base plate substantially perpendicular to said base plate in a common direction, said first, second, third and fourth flanges being in flush overlapping alignment proximal a midpoint of said spring-loaded roller hinge;

a fixed hinge hub passing through holes in said first, second, third and forth flanges to pivotally join said first and second brackets, said fixed hinge hub having flared ends to secure said fixed hinge hub to said brackets and between said third and fourth flanges, said fixed hinge hub being substantially parallel to and spaced a desired distance from said base plates;

a pivoting wheel hub passing through a hole in said third flange and an elongated slot in said fourth flange, said hole having a diameter sized to substantially flushly receive said pivoting wheel hub, and said elongated slot having a uniform width sized to substantially flushly accommodate said pivoting wheel hub, said slot having innermost and outermost ends and a length extending away from said base plate of said second bracket, said pivoting wheel hub having flared ends to secure said pivoting wheel hub to said second bracket and between said third and forth flanges at a location spaced from said fixed hinge hub, said wheel hub being pivotably joined to said third flange by pivoting about said hole in said third flange and being movingly guided by said fourth flange via said slot, and the axle of the wheel is received and held by said pivoting wheel hub;

a biasing mechanism joined to said spring-loaded roller hinge and engaging said pivoting wheel hub, said biasing mechanism biasing said moving end of said pivoting wheel hub toward engagement with said outermost end of said slot; and, wherein said spring-loaded roller hinge and biasing mechanism biasingly push the wheel against the inner end of the track to push the door toward the framing to seal the door opening when the door is in its closed position.

13. The overhead door assembly of claim 12, and wherein said wheel hub is pivotable through a range of motion between fully extended and fully retracted positions, said range of motion allowing said movable end of said wheel hub to move about ¼ inch and said hinge to close a gap of up to about ½ inch.

14. The overhead door assembly of claim 13, and wherein said biasing mechanism is a preloaded spring with opposed ends, said spring engaging said one base at one end and said wheel hub at said other end to biasingly push said movable end of said pivoting wheel hub away from said hinge base.

15. The overhead door assembly of claim 13, and wherein said biasing mechanism is a preloaded torsion spring producing a continuous and resilient pushing force, said torsion spring having a coiled section and first and second legs, said coiled section being coiled around said fixed hinge hub, said first leg extending into continuous forced engagement with said hinge base, and said second leg extending into continuous forced engagement with said pivoting wheel hub.

16. The overhead door assembly of claim 15, and wherein each said wheel pushes against its said inner end of said track with a pushing force of between about 5 to 23 pounds, and further including a force adjusting mechanism to adjust said pushing force, said force adjusting mechanism including at least one abutment in said base of said one bracket for engaging said first leg of said torsion spring, and said coil section of said spring being slidable along said fixed hinge hub between lower and higher force producing positions, said second leg engaging said pivoting wheel hub away from its said movable end when in said lower force producing position, and said first leg engaging said recess and said second leg engaging said pivoting wheel hub proximal its said movable end when in said higher force producing position.

17. The overhead door assembly of claim 12, and wherein said substantially vertical track portions are at a slight angle away from said framing to help avoid binding between said door and framing as said door moves up and down said vertical track portions, said upper ends of said vertical track portions being slightly further away from said framing than said lower ends of said vertical track portions;

said plurality of spring-loaded roller hinges including first, second and third matched sets of spring-loaded roller hinges;

each spring-loaded roller hinge in said first matched set having flanges of sufficient length to locate its said pivoting wheel hub a first predetermined distance from its said base plate;

each spring-loaded roller hinge in said second matched set having flanges of sufficient length to locate its said pivoting wheel hub a second predetermined distance from its said base plate, said second predetermined distance being an incremental amount greater than said first predetermined distance; and, each spring-loaded roller hinge in said third matched set having flanges of sufficient length to locate said pivoting wheel hub a third predetermined distance from its said base plate, said third predetermined distance being said incremental amount greater than said second predetermined distance.

18. The overhead door assembly of claim 17, and wherein each of the panels has a height of about 24 inches, said angle of the substantially vertical track portions relative to the framing is about ½ to 1 degree, and said incremental amount is about ¼ inch.

19. The overhead door assembly of claim 18, and wherein each hinge hub of said spring-loaded roller hinges has a hinge hub center line located about ¾ of an inch from its base plate, said pivot point of each of said first matched set of spring-loaded roller hinges is located about ¾ inch from its said base plate, said pivot point of each of said second matched set of spring-loaded roller hinges is located about 1 inch from its said base plate, said pivot point of each of said third matched set of spring-loaded roller hinges is located about 1¼ inch from its said base plate.

20. A set of spring-loaded roller hinges for an overhead door assembly that selectively opens and closes an opening in a building, the overhead door assembly including a multi-panel door held by opposed tracks with substantially vertical track portions fixed to opposed substantially vertical framing located along the sides of the opening, the tracks guiding and allowing selective movement of the door between open and closed positions, the door including a series of adjacent panels, each panel spanning the width of the opening and overlapping the framing, and each vertical track portion having an inner end, said spring-loaded roller hinge comprising:

a plurality of spring-loaded roller hinge sets, each said hinge set including two spring-loaded roller hinges, and each spring-loaded roller hinge including first and second brackets joined to pivot about a pivot centerline, each bracket being adapted for securement to one of the adjacent panels to allow hinged movement between the adjacent panels;

said first spring-loaded roller hinge being positioned proximal a first side of the door, and said second spring-loaded roller hinge being positioned proximal a second side of the door, said first bracket having first and second spaced flanges for supporting an elongated wheel hub, said first flange having a hole sized to receive and pivotally hold a pivotable end of said wheel hub about a pivot point, said second flange having a substantially horizontal elongated slot sized to receive and guide a laterally moving end of said wheel hub, said slot having outermost and innermost ends, said spring-loaded roller hinge including a mechanism to bias said moving end of said wheel hub away from its said hinge base and toward said outermost end of its said slot, each of said wheel hubs holding a roller wheel assembly formed by a wheel joined to an axle, said axle being received by said elongated wheel hub and said wheel located proximal said moving end of said wheel hub, said wheel being held and movingly guided by said track; and, wherein said biasing mechanism biasingly pushes said wheel against the inner end of the track to biasingly push the door toward the framing to seal the door opening when the door is in its closed position.

* * * * *